US007743799B2

(12) United States Patent
Mosler et al.

(10) Patent No.: US 7,743,799 B2
(45) Date of Patent: Jun. 29, 2010

(54) VENTED SAFE HANDLING VIAL ADAPTER

(75) Inventors: Theodore J. Mosler, Raleigh, NC (US); Bryan J. Peters, Raleigh, NC (US); Scott P. Jarnagin, Raleigh, NC (US)

(73) Assignee: Industrie Borta S.p.A., Moncalieri, Turin (IT)

( * ) Notice: Subject to any disclaimer, the term of this patent is extended or adjusted under 35 U.S.C. 154(b) by 686 days.

(21) Appl. No.: 11/593,328

(22) Filed: Nov. 6, 2006

(65) Prior Publication Data

US 2007/0106244 A1 May 10, 2007

Related U.S. Application Data

(60) Provisional application No. 60/734,165, filed on Nov. 7, 2005.

(51) Int. Cl.
*B65B 1/04* (2006.01)
*A61B 19/00* (2006.01)

(52) U.S. Cl. ..... 141/329; 141/302; 141/309; 141/325; 604/405; 604/406

(58) Field of Classification Search ..... 141/319–323, 141/329, 302, 309, 325; 604/403–416; 422/103
See application file for complete search history.

(56) References Cited

U.S. PATENT DOCUMENTS 3,902,516 A 9/1975 Rudolph
4,588,403 A 5/1986 Weiss et al.
4,600,040 A 7/1986 Näslund
4,607,671 A 8/1986 Aalto et al.
4,673,404 A 6/1987 Gustavsson
4,768,568 A * 9/1988 Fournier et al. ..... 141/286
4,895,275 A * 1/1990 Quinn et al. ..... 222/81
5,102,406 A 4/1992 Arnold
5,117,875 A * 6/1992 Marrucchi ..... 141/1
5,139,489 A * 8/1992 Hollister ..... 604/192
5,334,163 A 8/1994 Sinnett (Continued)

OTHER PUBLICATIONS

CLAVE® Drug Preparation System, Product Description, ICU Medical, Inc., San Clemente, CA, http://www.icumed.com, M1-1179 Rev. 2.

(Continued)

*Primary Examiner*—Timothy L Maust
(74) *Attorney, Agent, or Firm*—Christopher J. Knors; Moore & Van Allen, PLLC

(57) ABSTRACT

A vial adapter is described comprising a housing, the housing comprising an expandable chamber to contain a volume, an internal passage in communication with the expandable chamber, at least one opening in communication with the internal passage, and an access member integral with the housing. A hollow spike comprising a proximal end is integral with the housing and a distal end. The spike comprises a vent lumen open at the distal end and a fluid lumen open at the distal end, the vent lumen is in communication with the internal passage and the fluid lumen is in communication with the access member. A first check valve restricts communication from the expandable chamber to the internal passage, and a second check valve restricts communication from the internal passage to the opening. Methods of reconstituting and/or withdrawing hazardous material using the vial adapter are described.

62 Claims, 18 Drawing Sheets

U.S. PATENT DOCUMENTS

| | | | | |
|---|---|---|---|---|
| 5,423,791 | A * | 6/1995 | Bartlett | 604/403 |
| 5,575,279 | A * | 11/1996 | Beplate | 128/203.11 |
| 5,766,147 | A * | 6/1998 | Sancoff et al. | 604/520 |
| 6,113,583 | A | 9/2000 | Fowles et al. | |
| 6,253,804 | B1 | 7/2001 | Safabash | |
| 6,409,708 | B1 | 6/2002 | Wessman | |
| 6,544,246 | B1 | 4/2003 | Niedospial, Jr. | |
| 6,551,299 | B2 | 4/2003 | Miyoshi et al. | |
| 6,558,365 | B2 * | 5/2003 | Zinger et al. | 604/410 |
| 6,571,837 | B2 | 6/2003 | Jansen et al. | |
| 6,666,852 | B2 | 12/2003 | Niedospial, Jr. | |
| 6,715,520 | B2 | 4/2004 | Andréasson et al. | |
| 2004/0215147 | A1 | 10/2004 | Wessman et al. | |

OTHER PUBLICATIONS

CLAVE® IV Delivery System, Product Description, ICU Medical, Inc. , San Clemente, CA, http://www.icumed.com, M1-1180 Rev. 2.

GENIE™ Closed Vial Access, Product Description, ICU Medical, Inc. , San Clemente, CA, http://www.icumed.com, M1-1186 Rev. 2.

CMC™ Closed Male Connector, Product Description, ICU Medical, Inc. , San Clemente, CA, http://www.icumed.com, M1-1184 Rev. 2.

Closed System Solution, Product Description, Cardinal Health, San Diego, CA, http://www.cardinalhealth.com/texium.

* cited by examiner

VENTED SAFE HANDLING VIAL ADAPTER

CROSS-REFERENCE TO RELATED APPLICATION

This application claims the benefit of U.S. Provisional Application No. 60/734,165, filed Nov. 7, 2005, which is incorporated herein by reference in its entirety.

FIELD

This invention relates to the manipulation of hazardous material and more particularly to the reconstituting with a diluent and/or withdrawing a hazardous material in such a way as to substantially prevent the hazardous material from entering the immediate atmospheric environment.

BACKGROUND

Within the medical industry, medical personnel may be required to handle cytotoxic drugs, sometimes on a daily basis. A class of cytotoxic drugs is cytostatic chemotherapy agents. It is generally believed that cytostatics and some antibiotics may cause health problems if inhaled or exposed to the skin. Exposure or inhalation may be through leakage, aerosolization, or vaporization into the working environment during handling of the cytostatics.

Freeze dried or powdered cytotoxic drugs, including cytostatics, may be contained within a vial or drug container of the type which is sealed by an elastomeric stopper assembly disposed in sealing relation within an opening in the drug container so as to enable reconstitution of the freeze dried or powdered cytotoxic drug and to contain them therein. The elastomeric stopper assembly may receive a needle of a diluent containing syringe or other piercing-type device to introduce liquid. When the diluent is added into the drug container there is a volume of solution within the drug container that may compress the headspace gas therein and increase its pressure. It is generally known that this increase in pressure may cause a release of the solution containing the cytotoxic drug during this or subsequent access of the drug container. Leakage or an aerosol effect may result in the outward passage of portions of the cytotoxic drug in the form of aerosol or droplets through the elastomeric stopper assembly. This leaking or aerosolizing action presents a highly dangerous situation to the healthcare provider reconstituting the cytotoxic material with a diluent and/or other persons nearby or who may come in contact with the environment later, such as cleaning personnel.

The extent of aerosolizing may be minimized but not eliminated in the case of a one dosage vial. For example this may occur when the injection of the diluent into the drug container, the subsequent mixing of the diluent with the powder in the drug container, and the subsequent refilling of the mixture of the diluent and powder back into the syringe all take place without removing the connector from the elastomeric stopper of the drug container until after the single dosage has been withdrawn, This procedure may likely result in leaving some liquid in the drug container and a pressure in the drug container that does not completely reduce to atmospheric pressure. Thus, under these circumstances the small but existing pressure at the time of connector removal after refilling may likely result in some aerosolizing. All of the above mentioned problems of affecting a separate reconstituting procedure with a single dosage vial are multiplied in the case of multi-dosage vials.

Potential cytotoxic material contact with the user may occur when an injecting connector is removed as it is likely that some of the hazardous material solution may escape or be expelled or aerosolized from the connector end of the along with any included air.

SUMMARY

To address the aforementioned problems, a vial adapter is herein described adaptable to vials and drug containers containing toxic, cytotoxic and cytostatic materials. The vial adapter herein described equalizes the container to atmospheric pressure; remains closed—e.g., reduces or eliminates drops coming from the fluid inlet upon disconnection and vapors escaping reduced or eliminated; needle-free; and provides for equalizing pressure prior to withdrawal with filtered clean air entering the drug container.

In one embodiment, a vial adapter is provided. The vial adapter comprises a housing, the housing comprising an expandable chamber to contain a volume, an internal passage in communication with the expandable chamber, at least one opening in communication with the internal passage. An access member is integral with the housing. A hollow spike comprises a proximal end integral with the housing and a distal end. The spike further comprises a vent lumen open at the distal end and a fluid lumen open at the distal end, the vent lumen in communication with the internal passage and the fluid lumen in communication with the access member. A first check valve restricts communication from the expandable chamber to the internal passage, and a second check valve restricts communication from the internal passage to the opening.

In another embodiment, a vial adapter for a drug container fitted with a penetrable closure for entering the interior of the drug container and for removing material from or adding material to the drug container is provided. The vial adapter comprises a housing, the housing comprises a hollow spike comprising a fluid lumen having an open end and a vent lumen having an open end and an internal passage providing two-way communication with the interior of the drug container via the vent lumen. An access member provides two-way communication with the interior of the drug container via the fluid lumen, and an opening provides one-way fluid communication with the internal passage for maintaining the internal drug container at ambient pressure when removing material from the drug container via the access member and restricting fluid transfer from the internal passage into the ambient environment. An expandable chamber integral with the housing is in one-way fluid communication with the internal passage for maintaining the pressure of the drug container at ambient when adding material to the drug container via the access member and restricting fluid transfer from the expandable chamber.

In another embodiment, a vial adapter for a drug container is provided. The vial adapter comprises a housing having an upper section and a lower section in sealed relationship, each upper and lower section having a top and bottom surface. A hollow spike having a proximal end extends from the top surface of the lower housing section forming a flange, the spike further has a distal end extending from the bottom surface of the lower housing. The spike has a fluid lumen parallel with a vent lumen, the fluid lumen and vent lumen are open at the proximal end of the spike and are open proximal to the distal end of the spike. An access member is integral with the upper housing section, the access member having a two-way communicable passage through the fluid lumen of the spike. An opening through the upper housing is provided.

A filter is positioned between the upper and the lower housing sections. An internal passage is positioned between the upper and the lower housing sections, the internal passage in fluid communication with the opening and the vent lumen and isolated from the fluid lumen. A first check valve provides one-way fluid communication through the opening into the internal passage. An expandable chamber is integral with the housing and in fluid communication with the internal passage of the housing, the expandable chamber having a secured flexible member. And a second check valve provides one-way communication through the internal passage and into the expandable chamber.

In another embodiment, methods of reconstituting and/or withdrawing hazardous material are provided. The methods comprise providing a drug container comprising hazardous material and securing the vial adapter as herein described to the drug container. Reconstitution and/or withdrawal of hazardous material of the drug container is via the access member of the vial adapter such that positively displaced volume is one-way communicated to the expandable chamber and/or venting of the drug container is one-way communicated from the opening through the filter to the drug container.

Other embodiments and equivalents thereof will be apparent from the following detailed description when read in conjunction with the drawings.

DETAILED DESCRIPTION

Figure 1:
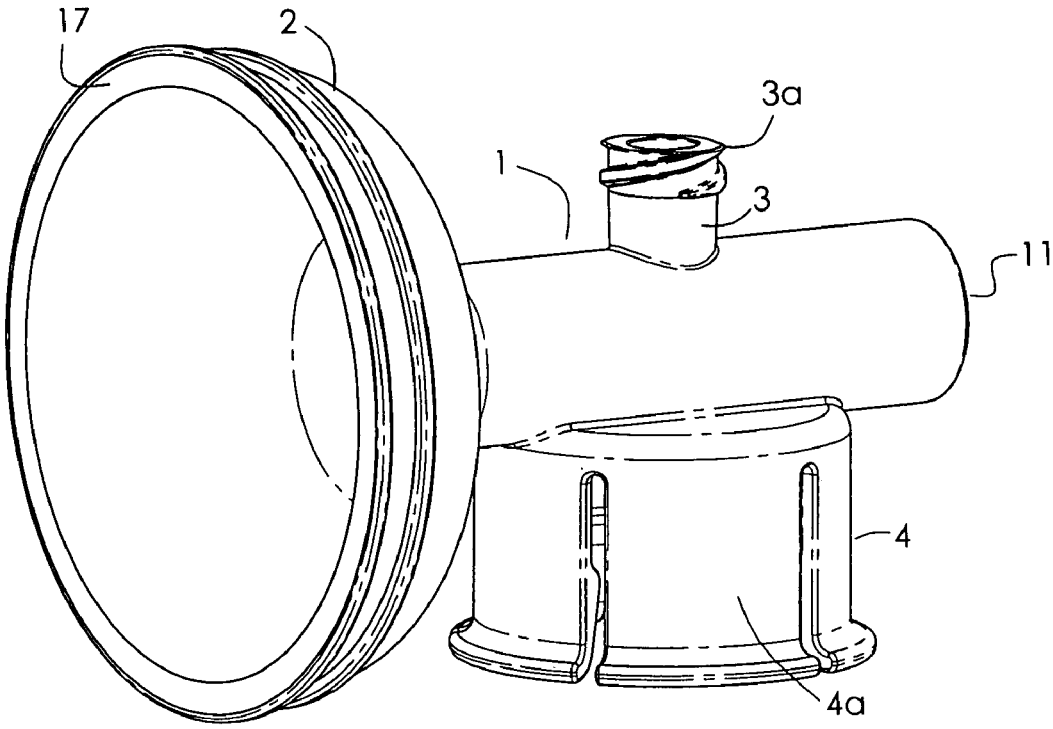
FIG. 1 is a perspective view of an embodiment of the vial adapter.

The safe-handling vented vial adapter disclosed herein may prevent or eliminate healthcare providers from being exposed to toxic, cytotoxic or cytostatic drugs by safely equalizing pressure and trapping potentially harmful vapors and drug between the drug vial and the syringe during their manipulation while performing treatment of patients or drug preparation. The vial adapter may keep harmful vapors trapped in the event the vial adapter is removed from the drug container prior to its disposal. The vial adapter described herein may eliminate or reduce the necessity to pre-pressurize the drug container with air before removing contents from it. Eliminating the need to pre-pressurize the drug container with potentially unclean air eliminates a step from the drug delivery process, reducing time and complication while increasing safety. The vial adapter described herein reduces the incidences of needlesticks by eliminating the need for sharpened metal needles used to access drug containers, further improving the safety and peace-of-mind of clinicians and cleaning personnel who come in contact with the device. This is accomplished by several cooperative and/or integrated features of the adapter, as described herein and summarized in the figure descriptions that follow.

The term "fluid" as used herein, refers to gas, liquid or a combination of gas and liquid.

A vial adapter is provided which comprises a housing. The housing may be of plastic construction or may be fabricated out of one or more materials designed to withstand chemical attack from substances, such as cytotoxic drugs and other IV drugs. Materials include for example, thermoplastics, engineering thermoplastics, filled or unfilled, and composites. Thermoplastics include materials such as polybutylene terephthalate (PBT), polyethylene terephthalate (PET) polyethylenenaphthalate (PEN), cyclic olefinic copolymers (COC's) and polycarbonate (PC).

The housing comprises an expandable chamber to contain a volume, an internal passage in communication with the expandable chamber, at least one opening in communication with the atmosphere and the internal passage, and an access member integral with the housing. The vial adapter further comprises a spike comprising a proximal end integral with the housing and a distal end, the spike further comprising a vent lumen open proximal to the distal end and a fluid lumen open proximal to the distal end, the vent lumen in communication with the internal passage, the fluid lumen in communication with the access member. The vial adapter functions to allow the connector at the end of the syringe or other device to be safely removed or disengaged from the access member of the vial adapter avoiding release of material from the drug container. When adding material to the drug container, the differential volume is received and contained within the expandable chamber while ambient pressure in the internal passage and drug container is maintained. When removing material from the drug container, the differential volume is replaced via the one-way check valve of the opening in communication with the internal passage, while ambient pressure in the drug container is maintained. The vial adapter further provides for fluid in the syringe or other device to pass through the open end of the syringe or other connecting device into the vial adapter without a build up of pressure in the assemblage of syringe or other device, housing and drug container.

The vial adapter housing includes a hollow spike which is proximately integral to the housing and open proximal to its distal end for communicating with the drug container. The spike may include at least two lumens both of which may be open proximal to the distal end of the spike and function independently of each other. The openings in the lumens may be at the distal end of the spike, the side of the spike or one lumen opening may be at the distal end of the spike and another lumen opening may be on the side of the spike. The relative positions of the openings of the lumens proximal to the distal end of the spike may be the same or different. The spike may be constructed of plastic, metal or composite material. The spike may be designed such that it easily pierces the closure of the drug container. The open end of the spike may be pointed and/or beveled for facile insertion into a closure of a drug container.

The vial adapter includes an opening in communication with the internal passage. The opening provides for one-way communication of the internal passage with the atmosphere. One-way fluid communication may be achieved by any means capable of restricting fluid flow, such as a check valve. The opening may be in communication with a check valve disposed in cooperating relation with the internal passage for providing ambient pressure within the vial adapter and drug container while preventing escape of hazardous material. The communication between the opening and the internal passage and/or vent lumen may be filtered to avoid contamination of the contents of the drug container. In this arrangement, the contents of drug container may be reconstituted and/or withdrawn under uncontaminated atmospheric pressure conditions.

Check valves may be employed as to provide essentially one-way fluid transport through the internal passage. Check valves may be employed as a cooperative pair. Check valves may be assembled in a manor that will allow air to vent into the drug container from the atmosphere and urge vapors from the drug container and any aerosolized drug that may enter the internal passage through the vent lumen to enter into the expandable chamber. The cooperative pair of check valves prevents or restricts vapors from escaping the opening and the expandable chamber. The cooperative relationship between the pair of check valves includes, for example, one check valve allowing fluid flow and the other check valve essentially concurrently restricting or preventing flow. The check valves preferably have a low cracking pressure so as to prevent or eliminate pressure to build up in any area of the system. The cracking pressure preferably is less than 2 psi, less than 1 psi or less than 0.5 psi. The check valve pair may also have a low reverse leakage characteristic to prevent hazardous media from being released into the internal passage or the environment. Check valves include, for example, "duck bill" type or "spiral" type. Various other types of check valves may be used, for example "top hat", "double duck bill", "umbrella", "flat disc", etc.

A filter may be disposed in cooperating relation with at least one one-way vent opening for enabling the pressure within the vial adapter to remain at atmospheric conditions while preventing movement of hazardous material outwardly through the vent opening. The filters may be sized commensurate with the overall size of the vial adapter or its components. The filter may be of a disk-type or any other size sized to fit cooperatively with a check valve. The disk filter may have a hydrophobic surface on one side or on both sides of the disk. The filter may contain a small pore size, such as 1.0, 0.5 or 0.2 micron, however, larger or smaller pore sizes may be used. The filter may include the hydrophobic surface in communication with the vent lumen of the spike and surrounding areas to prevent wetting of the filter media, assuring adequate ability to equalize pressure within the system. The filter, and preferably in combination with the check valve, may provide that the drug container and vial adapter avoids or resists becoming pressurized above atmospheric pressure, which would present the undesirable possible exposure to potential aerosolization, spraying, or dripping of the drug when a device is disconnected therefrom. Multiple filters may be used. The selection of filter type and size may be readily determined to provide adequate surface area and to effectively vent the device quickly under normal use.

The internal passage is in one-way communication with the expandable chamber. The expandable chamber is operable in response to the effect of positive pressure within the internal passage. The expandable chamber is adapted to receive and retain the fluid volume communicated therein and to maintain atmospheric conditions in the internal passage. The expandable chamber may comprise a membrane which forms all or part of the chamber. For example, the expandable chamber may comprise a flexibly expandable membrane portion sealed to a rigid portion.

The vial adapter includes an access member. The access member provides two-way communication with the fluid lumen of the spike. While in sealable communication with a drug container, the access member provides for introduction or withdrawal of fluid using a syringe or other device from the drug container. The fluid communication between the access member and the fluid lumen may be filtered. The access member of the vial adapter mounted thereon may provide a sealed septum or similarly constructed valve capable of receiving a device for needle-free introduction of fluid to or withdrawal of fluid from a drug container. The access member may comprise a needle-free adapter. The needle-free adapter may be a female luer-activated two-way adapter or male luer adapter. The needle-free adapter may be secured to the access member of the housing. Various needle-free adapters as are known in the art are adaptable to the vial adapter housing, such as CLAVE®, SMARTSITE®, POSIFLOW®, BIONECTOR®, and CLEARLINK® and others. The needle-free adapters in combination with the vial adapter herein described provides for accessing the drug container for introduction and/or withdrawal of fluid under ambient pressure through the closure of the drug container. Hence, elimination or reduction of aerosolized hazardous material into the environment incident to withdrawal as the needle-free adapter self-seals is reduced or eliminated and further provides for needle-free manipulation.

The expandable chamber of the vial adapter may be mounted on the housing or be integral therewith. The expandable chamber accepts a displaced volume from the drug container and transitions from an initial position to a final position. The initial volume of the expandable chamber is at a minimum in the initial position while the final volume of the expandable chamber at the final position is greater than the initial volume. The final volume of the expandable chamber may be adapted to correspond with a predicted volume that may be introduced into the drug container.

The increase of the volume of the expandable chamber may be provided by movement of a flexible membrane from an initial position to a final position. Other expandable materials suitable for use as the expandable chamber will be readily apparent to those of ordinary skill in the art. The expandable chamber itself may comprise a portion capable of expanding from an initial position to a final position. The flexible membrane may comprise a high gas and/or liquid barrier film. The flexible film may be of a low elastic modulus. The flexible film is used to provide the expandable chamber with a variably expanding volume isolated from the interior passage of the housing and the atmosphere. The film may be sealed to the face of the housing or surrounding area. The vial adapter may be designed such that a pair of cooperative check valves in the device causes the film in its motion to expand the expandable chamber to a larger volume while preventing its return to its original volume. Thus, during normal use of the vial adapter, air may be forced out of the drug container and be directed into the expandable chamber by the check valve pair and expand the thin film of the expandable chamber outward creating a larger volume. The internal volume of the chamber may be maintained or be further expanded under normal use of the device and may be restricted thereafter from reducing its volume. The volume of the chamber may be prevented from being compressed to a smaller volume after it is expanded, for example by one or both of the check valves. Thus, harmful vapors within the device remain essentially contained within the expandable chamber to further enhance the safety of the device. The vial adapter thus provides for the user to remove the vial adapter from the drug container between usage or prior to its disposal.

Withdrawal of a volume from the drug container may occur with two-way fluid communication through the access member of the vial adapter housing and the fluid lumen of the spike. Maintenance of the drug container at atmospheric pressure conditions result from one-way air draw from the housing opening through the internal passage and vent lumen, thus safely venting the drug container for ease and speed of withdrawal.

The vial adapter may be adapted to be mounted on a drug container via a skirt so as to provide secured, reversibly sealed engagement with the drug container and provide for fluid reconstitution and/or withdrawal of hazardous material contained therein. The skirt may be integral with the vial adapter for fixedly securing the vial adapter to a drug container or may be adapted to be joined thereto prior to use. The skirt may at least partially surround the spike and provide for the distal end of the spike to pierce the closure of the drug container and be disposed in sealed relation to the interior of the drug container. The skirt may include segments, such as flexible fingers, having vertical gaps therebetween. The segments may include undercut features to secure the vial adapter to the drug container. The undercut features may flex outward due to the presence of the undercut features and the vertical gaps. The skirt and segments may be of plastic construction. The spike area and segment spacing may be of a size to fit a variety of sizes of drug container vials, such as between 13 mm and 33 mm. For larger sized vials and drug containers and for the opportunity for universal use, the skirt may be integral with the housing or may be eliminated from the housing, so that the device may be adapted to any size vial or drug container.

Figure 2:
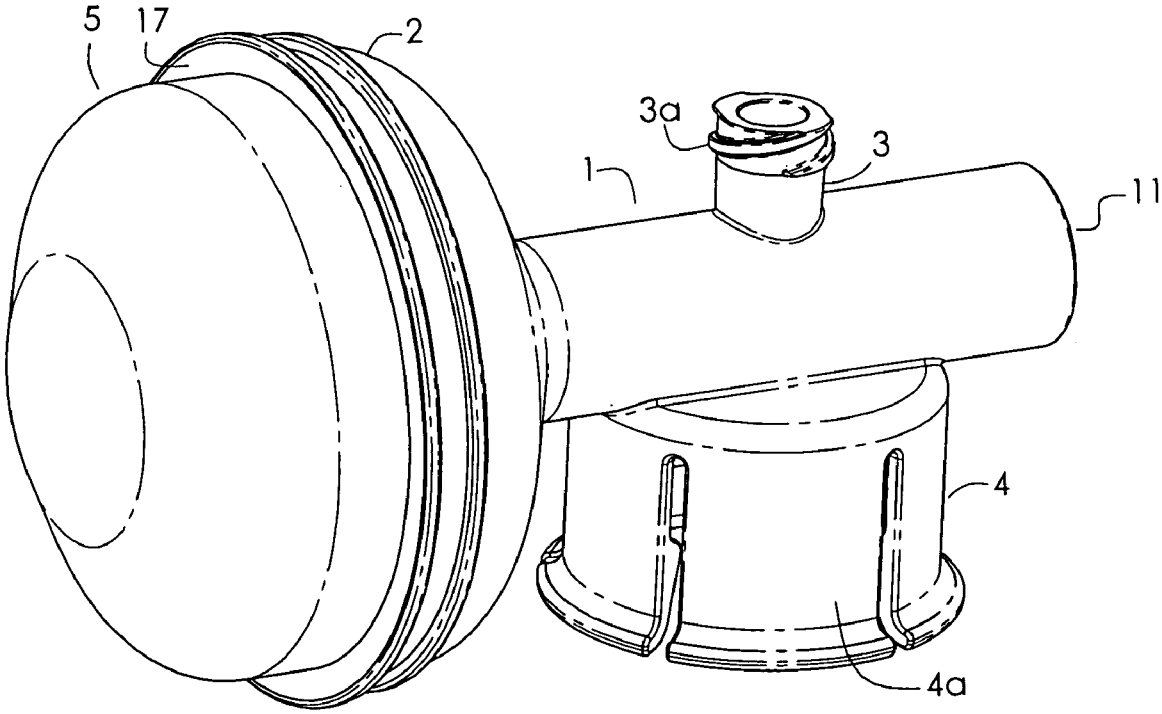
FIG. 2 is a perspective view of the embodiment as shown in FIG. 1 with the expandable chamber in an expanded state.
Figure 3:
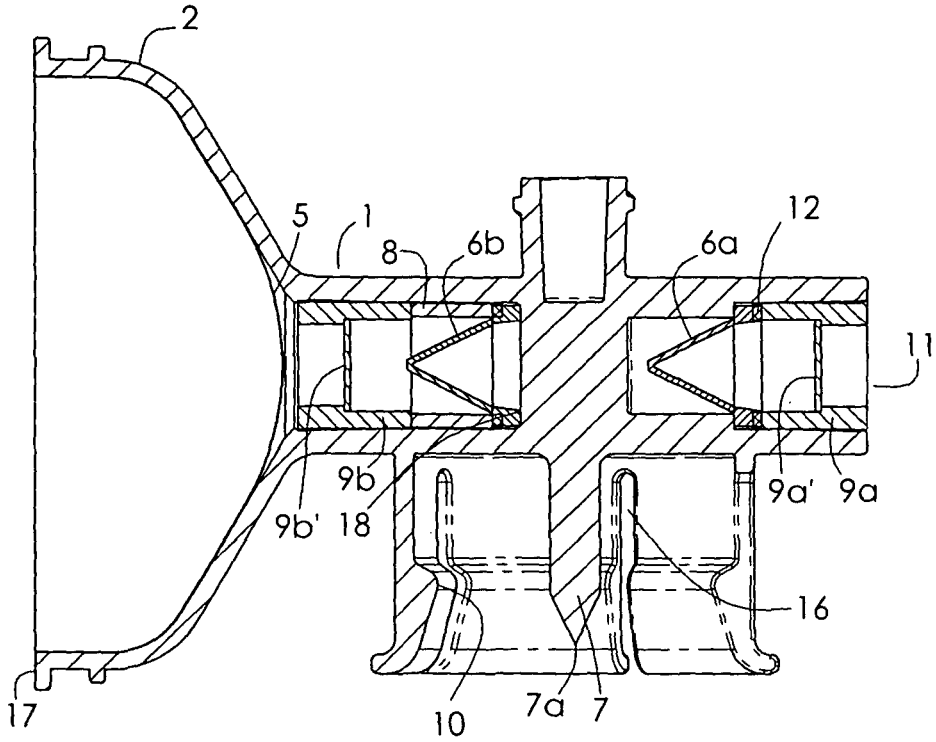
FIG. 3 is a side cross-section view of the embodiment as shown in FIG. 1.

Referring now to the drawings, various illustrative embodiments will be described. FIGS. 1-6 depict an embodiment of the vial adapter. FIGS. 1-2 are perspective views of the vial adapter including housing 1 which includes access member 3 with threaded attachment means 3*a*, expandable chamber 2 adjoining the housing 1; Expandable chamber 2 includes flanges 17 and 17*a* providing groove 17*b*. Skirt 4, integral with housing 1, includes vertical gaps 16 providing segments 4*a* and undercuts 10 for attachment to a drug vial. Flexible membrane 5 conforming to inside surface of expandable chamber 2 is sealed to edge of expandable chamber 2 at flange 17. Alternatively, membrane 5 may include means cooperatively securable to chamber 2 via groove 17*b*. The membrane may be a flexible film of low elastic modulus. Unexpanded and expanded flexible membrane 5, sealed at face seal 17 of expandable chamber 2, is shown in an initial and final position in FIG. 1 and FIG. 2, respectively. FIG. 2 depicts the vial adapter configuration post-injection of a volume via access member 3. Membrane 5 of expandable chamber 2 expands from an initial volume to a volume greater than the initial volume. Vapor and/or air within the drug container are urged upon injection of a volume into drug container 100 through check valve 6*b* and are secured in chamber 2. Opening 11 and check valve 6*a* provide for one-way communication with, internal passage 15 as depicted in FIG. 3. Check valve 6*b* provides one-way communication with expandable chamber 2. When fluid is withdrawn from a drug container via fluid lumen and access member, pressure is equalized in the system by air being drawn through filter assembly 9*a* and check valve 6*a* into internal passage 15 and into drug container via vent lumen 14.

Figure 4:
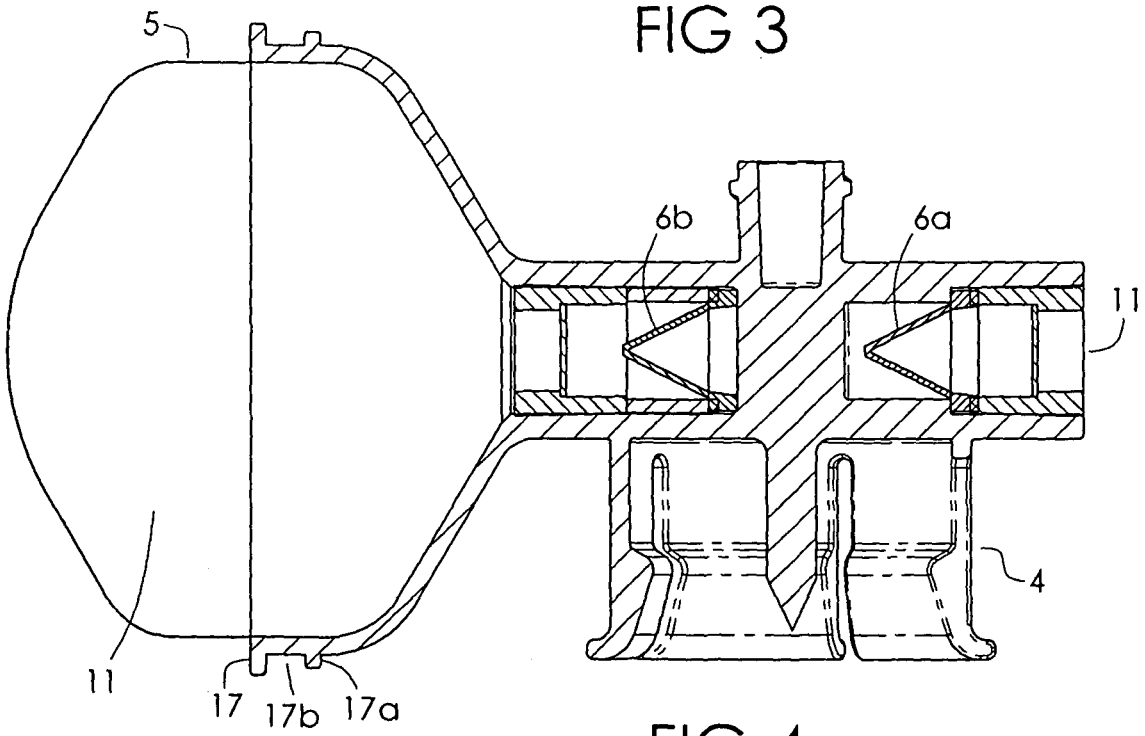
FIG. 4 is a side cross-section view of the embodiment as shown in FIG. 2.

FIGS. 3-4 are sectional views of the vial adapter housing including filter assemblies 9*a* and 9*b* having filters 9*a*' and 9*b*', respectively. Filter assembly 9*a* is seated in opening 11 securing check valve 6*a*. Spacer 8 adjoining filter assembly 9*b* bridges and secures check valve 6*b* in the housing. Face seal 12 compresses the check valve 6*a* in mating relationship with filter assembly 9*a*. Face seal 18 compresses the check valve 6*b* in mating relationship with filter 9*b*. Spacer 8 may be integral with the filter assembly.

Figure 5:
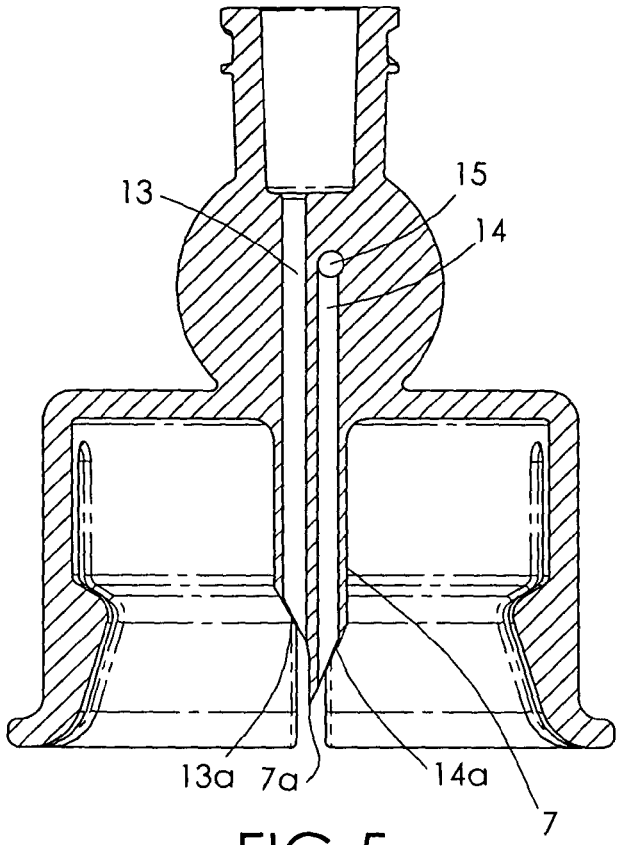
FIG. 5 is a side cross-section view of the embodiment as shown in FIG. 1, normal to FIG. 3.
Figure 6:
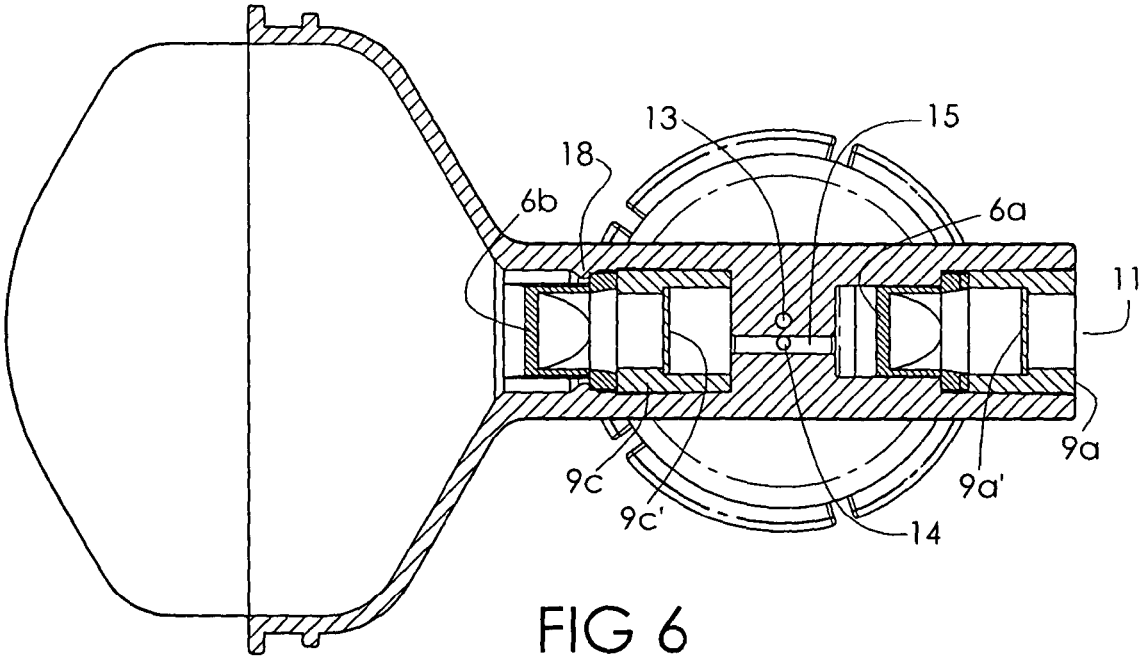
FIG. 6 is a top cross-section view of the embodiment as shown in FIG. 1.

Spike 7 is proximally attached to housing 1 and positioned within skirt 4 and includes openings proximal to distal end 7*a* having a shape for penetrating a drug container closure. FIG. 5 depicts a longitudinal sectional view of vial adapter housing including internal passage 15 communicable with vent lumen 14 through opening 14*a* proximal to distal end 7*a* of spike 7. Fluid lumen 13 is communicable with access member 3 through opening 13*a* proximal to distal end 7*a* of spike 7 and isolated from vent lumen 14. FIG. 6 depicts a top sectional view of vial adapter housing including alternative check valve-filter assembly arrangement. Lip 18 secures and compresses check valve 6*b* with filter assembly 9*c*. In this configuration, check valve 6*b* is positioned between expandable chamber 2 and filter assembly 9*c* and filter 9*c*'. Undercut features 10 of flexible vertical sections 4*b* defined by vertical gaps 16 of skirt 4 provide securing means for securing the vial adapter to a drug vial.

Figure 7:
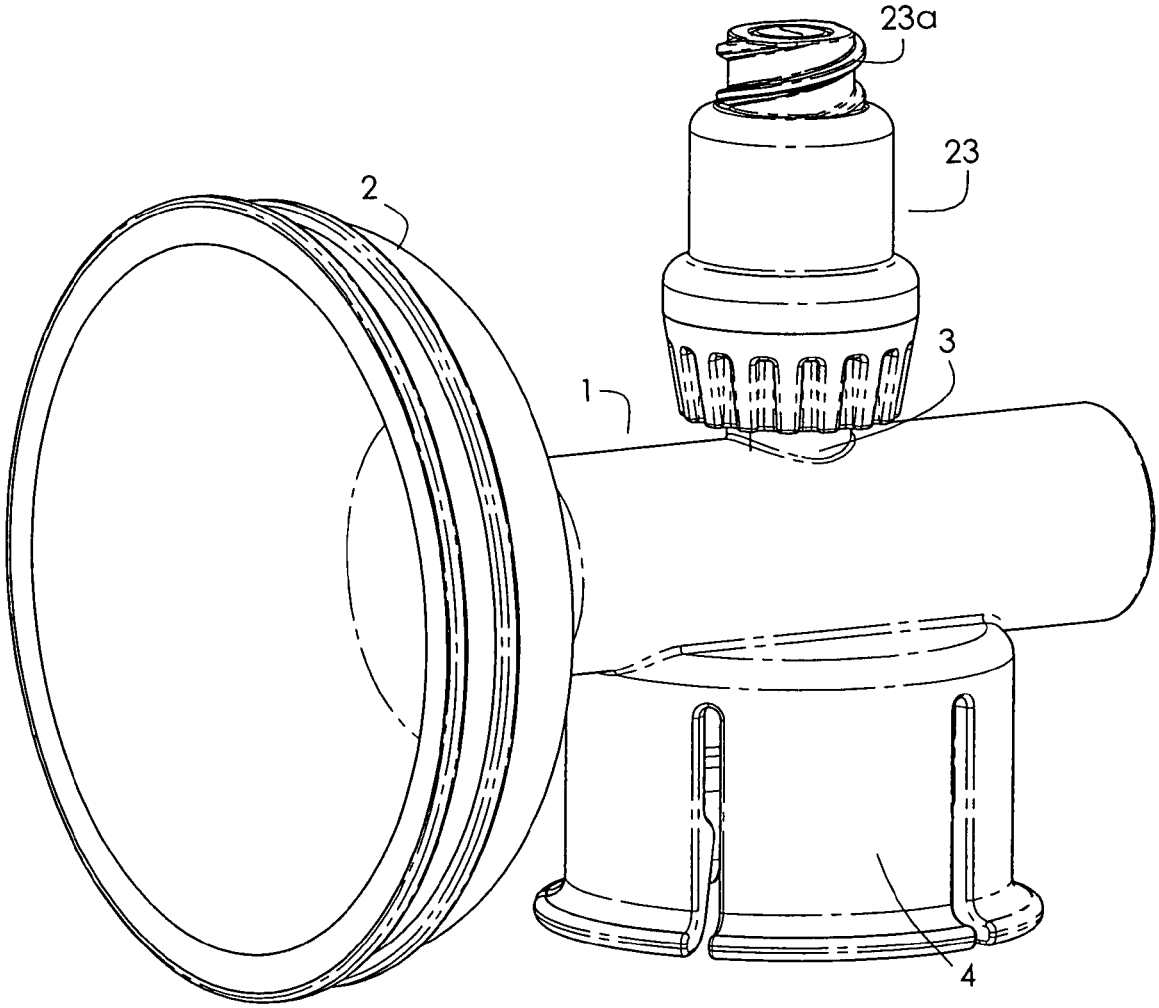
FIG. 7 is a perspective view of an embodiment as shown in FIG. 1 with an integral valved access member.
Figure 8:
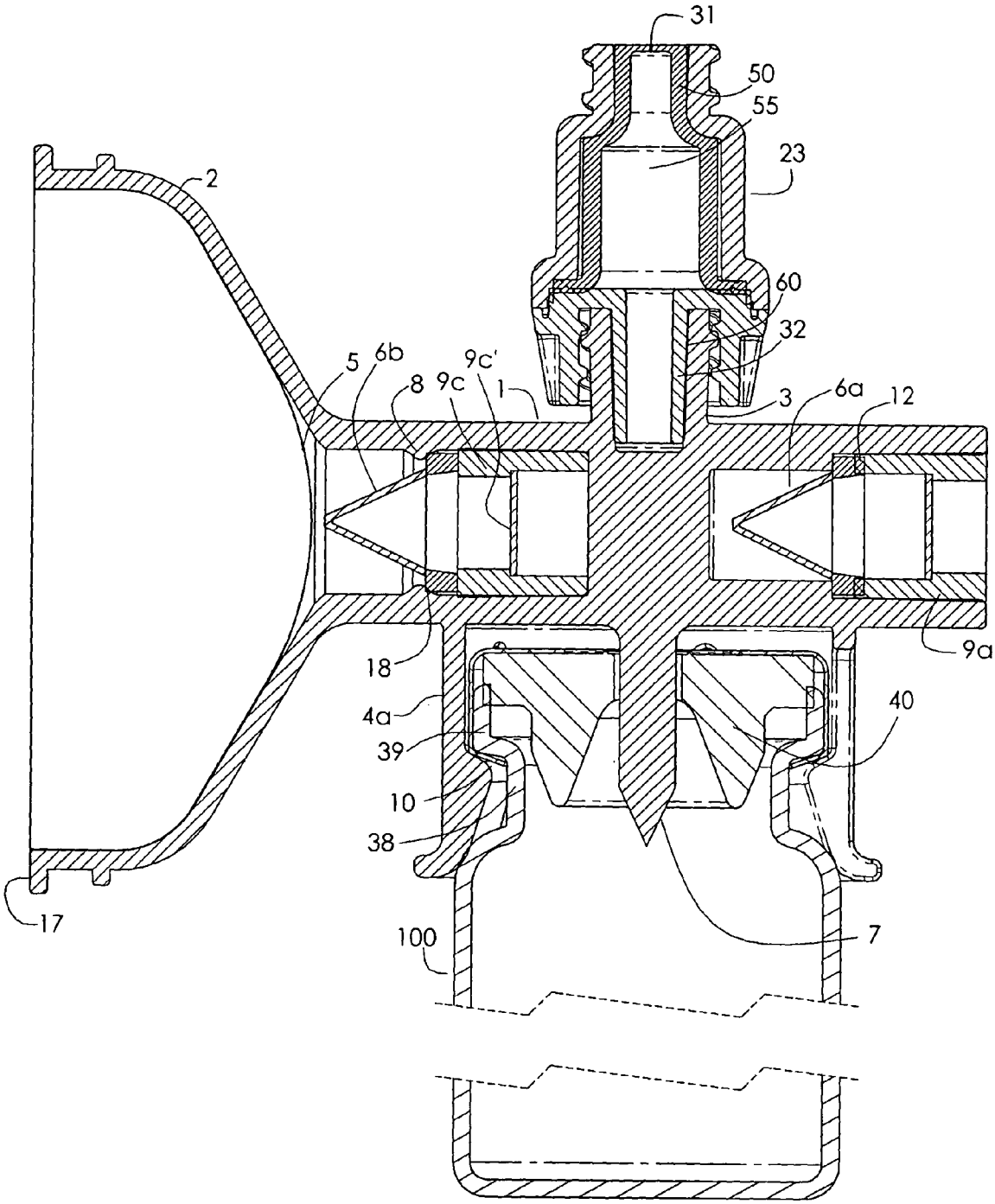
FIG. 8 is a side cross-section view of the embodiment as shown in FIG. 7.

Referring now to FIGS. 7-8, FIG. 7 shows vial adapter including generic needle free valve assembly 23 having threaded elements 23*a* secured to access member 3. Needle free valve assembly 23 provides for needle-free access to drug container by a needle-free syringe or other device. FIG. 8 depicts a section view of the vial adapter with generic needle free valve assembly 23, the vial adapter in sealable engagement with drug container 100. Generic needle free valve assembly 23 includes elastomeric member 50 sleeved on conduit 55. Male element 32 engages female element 60 of access member 3. Slit 31 in elastomeric member 50 provides re-sealable communication with vial adapter housing 1. Undercut features 10 of segments 4*a* surround neck of drug container 38 and are interfered by drug container cap 39. Spike 7 penetrates septum 40 of cap 39 to provide access to drug container 100.

Figure 9:
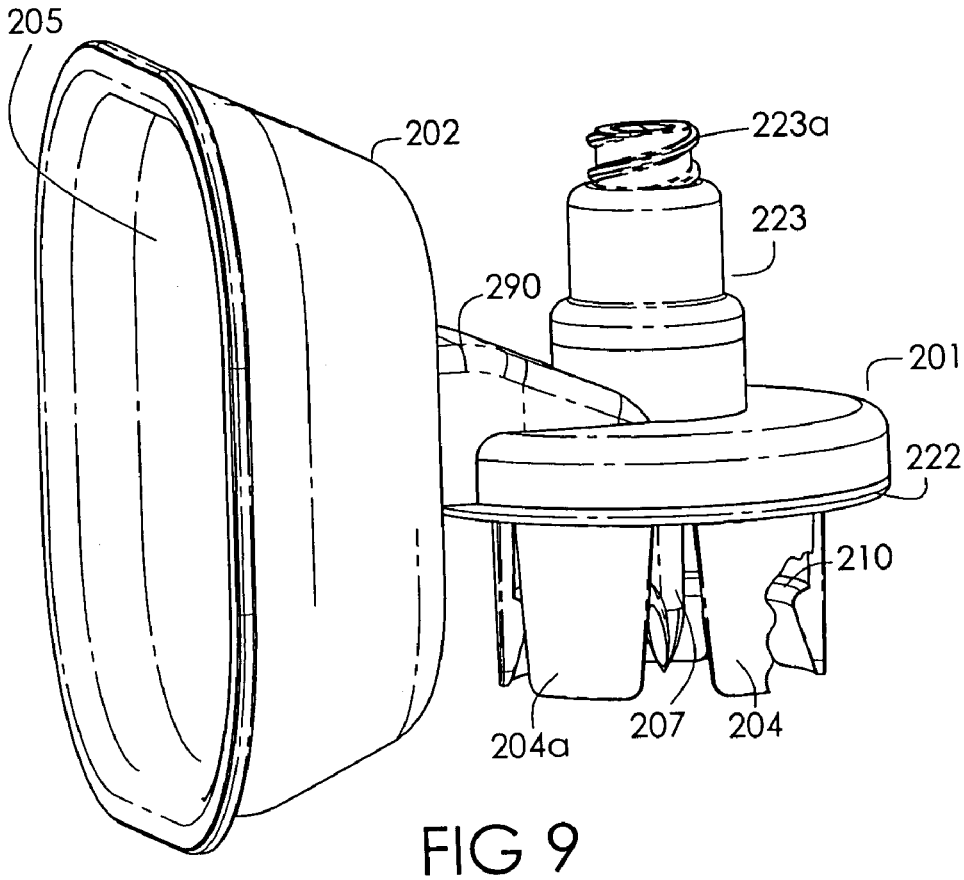
FIG. 9 is a perspective view of an embodiment of the vial adapter as assembled.
Figure 10:
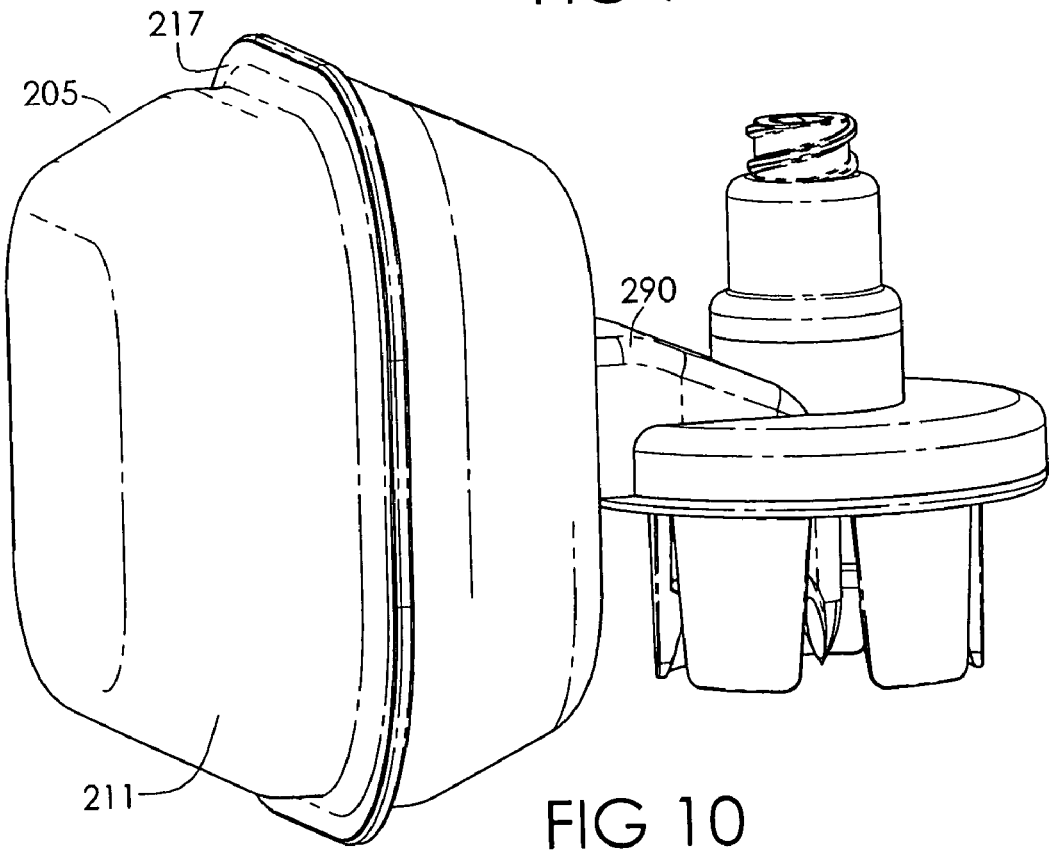
FIG. 10 is a perspective view of the embodiment as shown in FIG. 9 with the expandable chamber in an expanded state.

Referring now to FIGS. 9-22, which depict another vial adapter embodiment, FIG. 9 shows a partial sectional perspective view including disk-shaped upper housing 201 mated with lower housing 222. Generic needle free valve assembly housing 223 is integral with upper housing 201. Expandable chamber 202 projects laterally from upper housing supported by housing portion 290. Lower housing 222 includes skirt 204 and segments 204*a* surrounding spike 207. Segments 204*a* include undercuts 210 for securing vial adapter to neck 38 and cap 39 of drug container 100. Unexpanded and expanded flexible membrane 205, sealed at face seal 217 of expandable chamber 202, are shown in an initial and final position in FIG. 9 and FIG. 10, respectively.

Figures 11, 12:
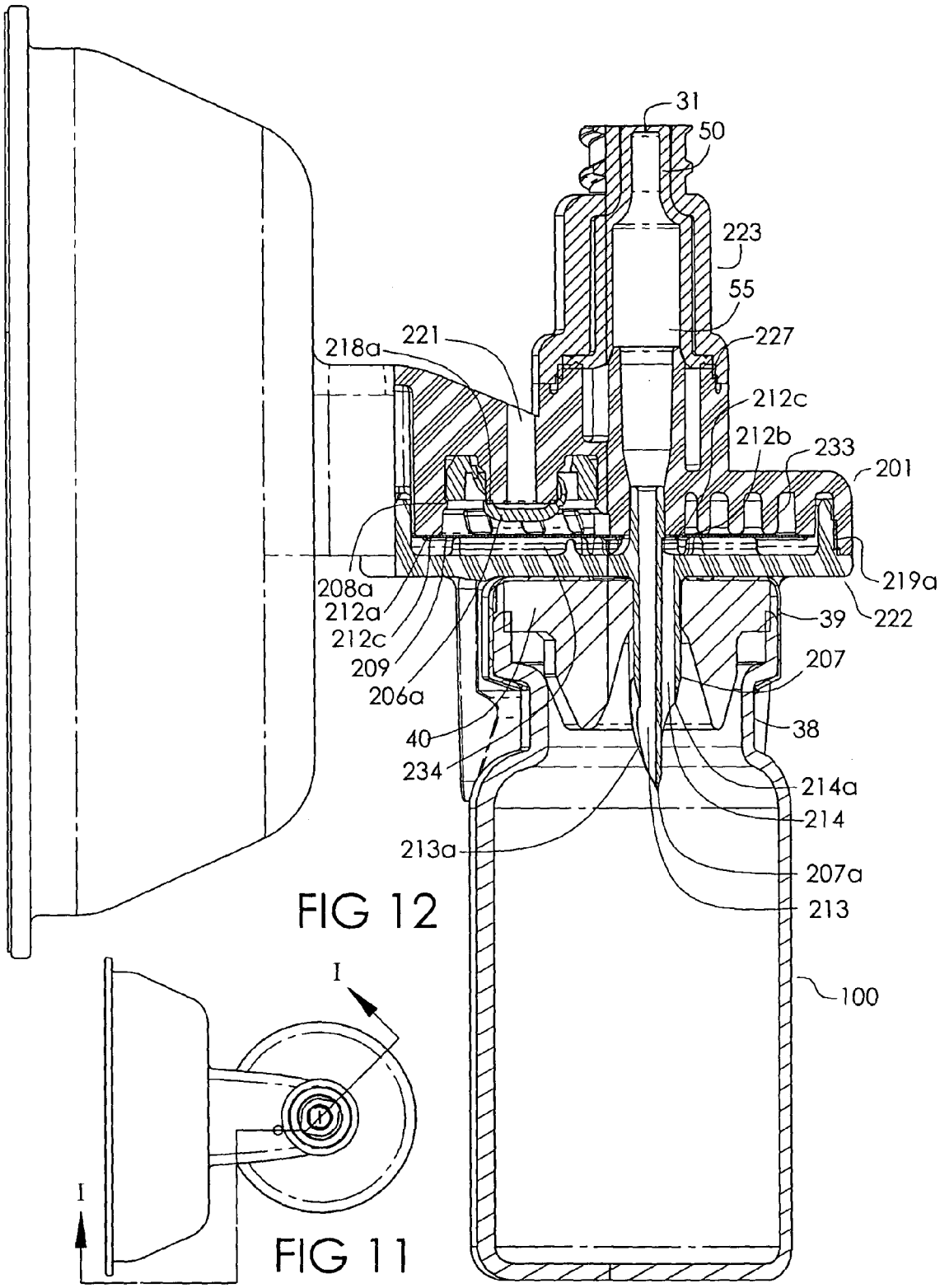
FIG. 11 is a top view of the embodiment as shown in FIG. 9.
FIG. 12 is a side cross-section view of the embodiment as shown FIG. 11, attached to a drug container.
Figure 14:
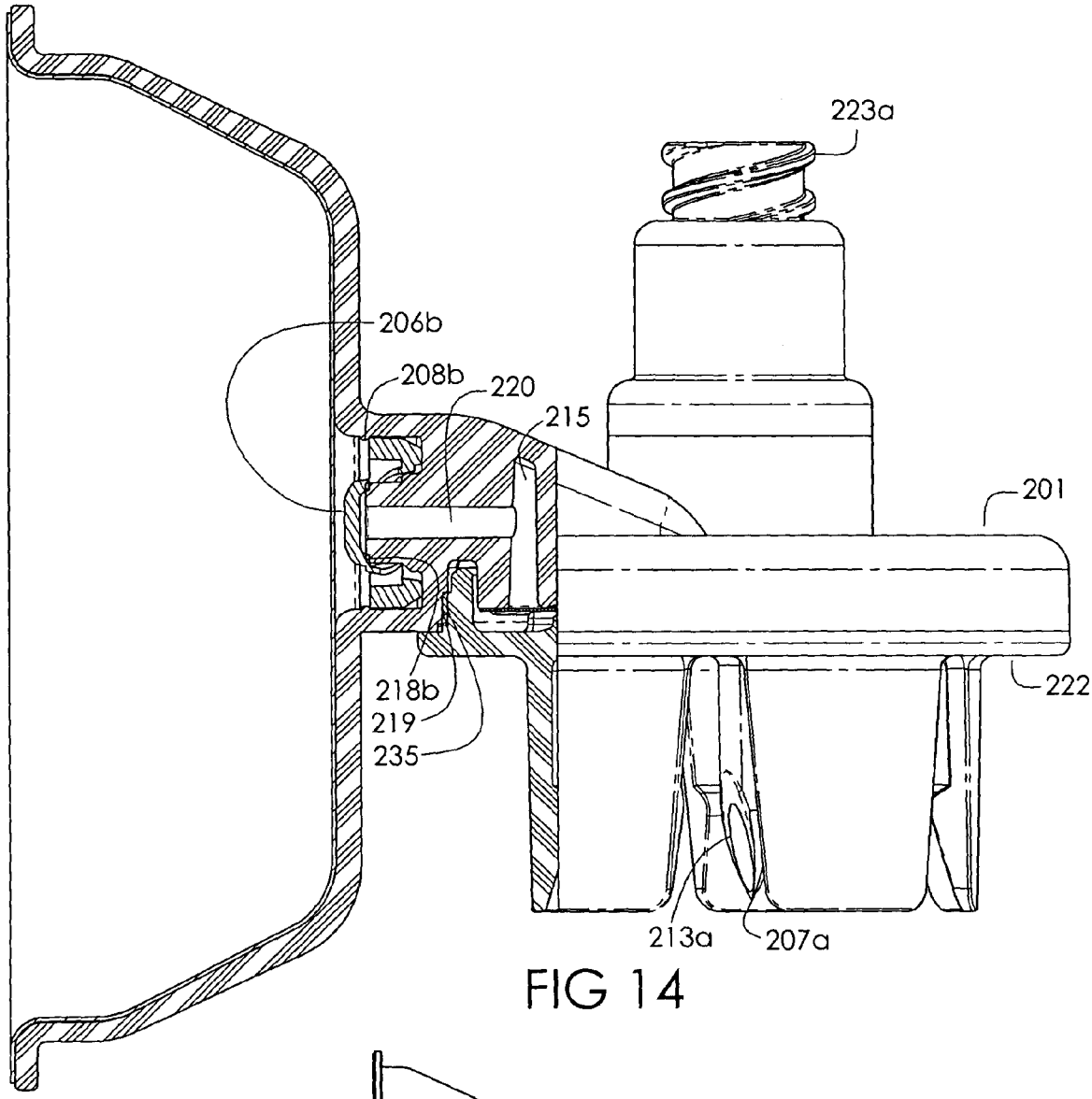
FIG. 14 is a side cross-section view of the embodiment as shown FIG. 13.
Figure 13:
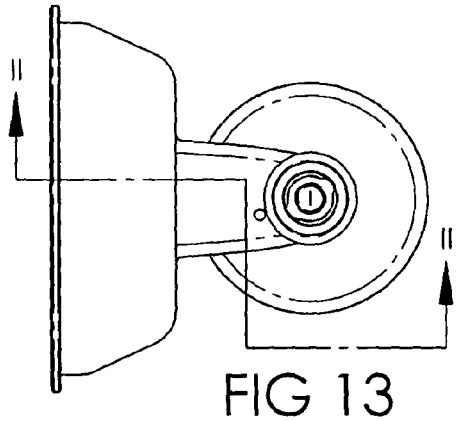
FIG. 13 is a top view of the embodiment as shown in FIG. 9.

FIGS. 12-14 depict partial sectional views of the aforementioned vial adapter embodiment engaged with drug container 100. Generic needle free valve assembly 223 includes elastomeric member 50 sleeved on conduit 55 and secured on seat 227. Slit 31 in elastomeric member 50 provides re-sealable communication with vial adapter housing 201 and fluid lumen 213. Opening 213*a* of fluid lumen 213 proximal to spike distal end 207*a* is positioned forward of opening 214*a* of vent lumen 214. Opening 213*a* may be positioned rearward of 214*a* or may be positioned equally with 214*a*. Positional arrangement of openings 213*a* and 214*a* may be arranged as needed to prevent or eliminate crosstalk between the vent and fluid lumens during use. Spike 207 penetrates septum 40 of cap 39 to provide access to drug container 100. Filter 209 is sealed to upper housing 201 at sealing surfaces 212*a* and 212*b*, and supported by upper and lower support ribs 233 and 234, respectively. Energy directors 212*c* may be utilized on sealing ribs 212*a* and 212*b* for ultrasonic welding. Other surface effects, such as adhesives or heat sealing may be used to seal filter 209 to upper housing 201. Check valve 206*a* is sleeved on flange seat 218*a* and secured by annular ring protrusion 208*a*. Upper housing 201 is assembled to lower housing 222 by ultrasonically welding shear element 219 of the upper housing 201 to shear element 235 of the lower housing 222 to form shear joint 219*a*. Other ultrasonic weld joints could be incorporated, such as an energy director weld, or other joining processes such as spin welding, adhesives, and the like.

Figure 15:
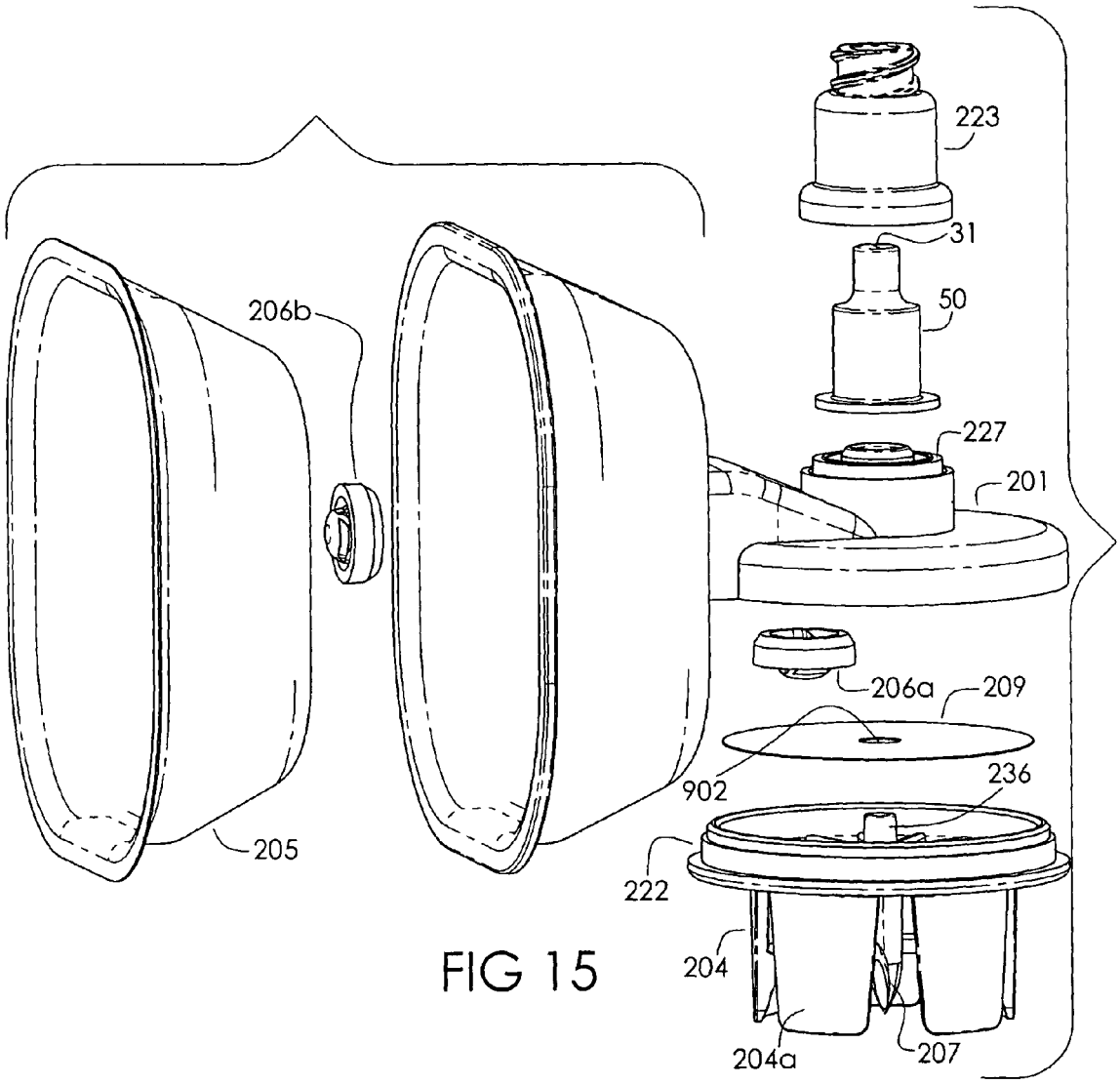
FIG. 15 is an exploded perspective view of the embodiment as shown in FIG. 9.
Figure 16:
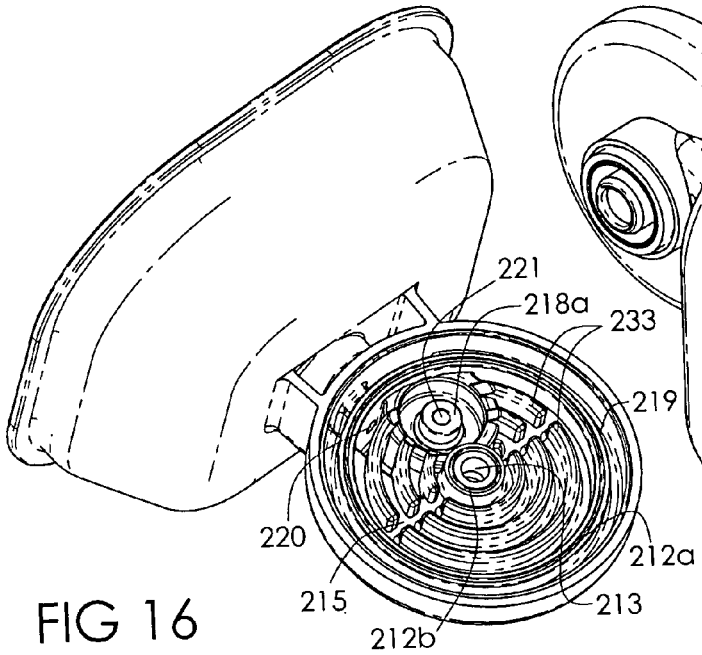
FIGS. 16-19 are various views of the upper housing of the embodiment as shown in FIG. 9.
Figure 17:
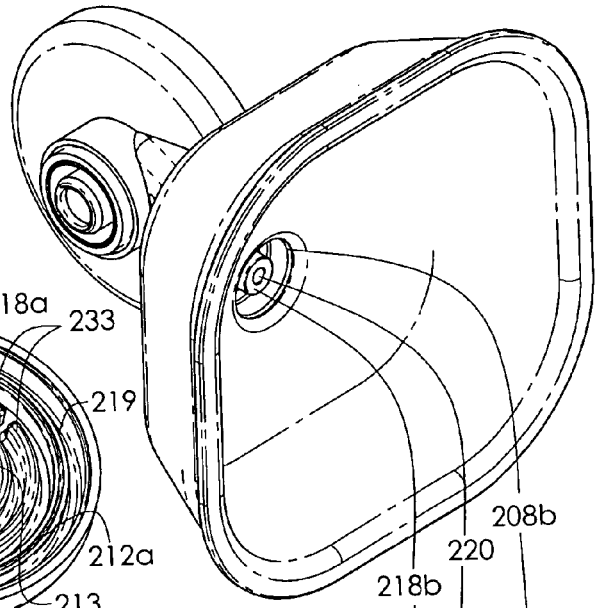
Figure 18:
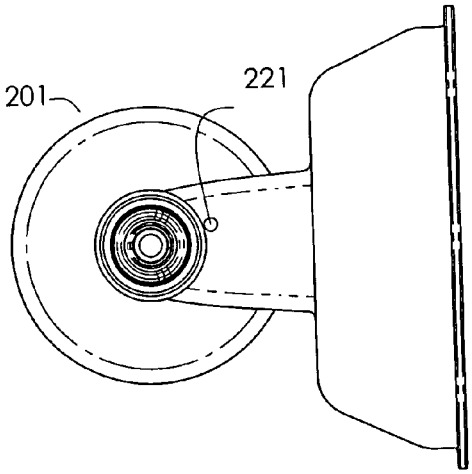
Figure 19:
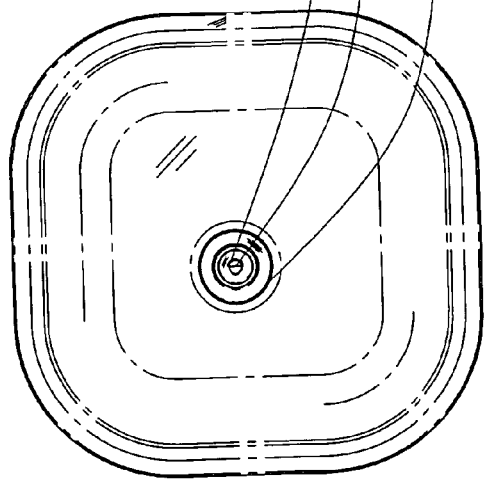

Referring now to FIGS. 13-14, check valve 206*b* is sleeved on flange seat 218*b* and secured by annular ring protrusion 208*b*. Passage 220 is in communication with internal passage 215. Passage 220 together with passage 215 in combination with check valve 206*b* provides for one-way communication with vent lumen 214 and is cooperative with the combination of check valve 206*a* and passage 221 to direct fluid within the vial adapter. Shear weld 219*a* provides for assembly of upper and lower housings 201 and 222, respectively. FIG. 15 is an exploded view of the vial adapter embodiment of FIGS. 12-14. Filter 209 has opening 902 for sleeving on flange 236 of lower housing 222.

Referring now to FIGS. 16-19, upper housing 201 includes check valve flange seat 218*a* with passage 221 through upper housing 201. Upper support ribs 233 provide internal passage 215. Internal passage 215 provides for communication between passages 220 and vent lumen 214 as well as communication between passage 221 and vent lumen 214. Upper housing shear weld element 219 and sealing surfaces 212*a* and 212*b* provide securing means for filter 209 upon assembly. Check valve 206*a* provides one-way communication with opening 221.

Figure 21:
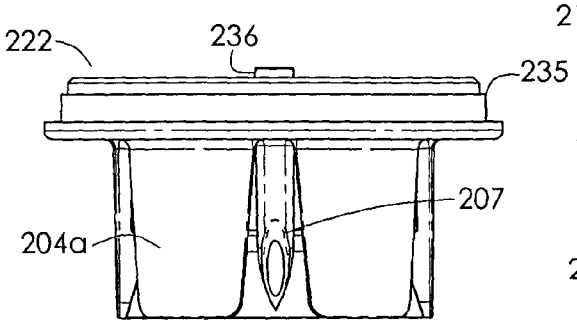
FIGS. 20-22 are various views of the lower housing of the embodiment as shown in FIG. 9.
Figure 22:
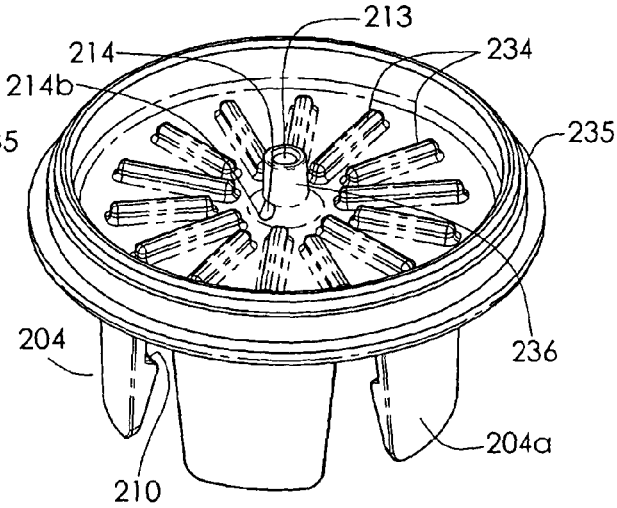
Figure 20:
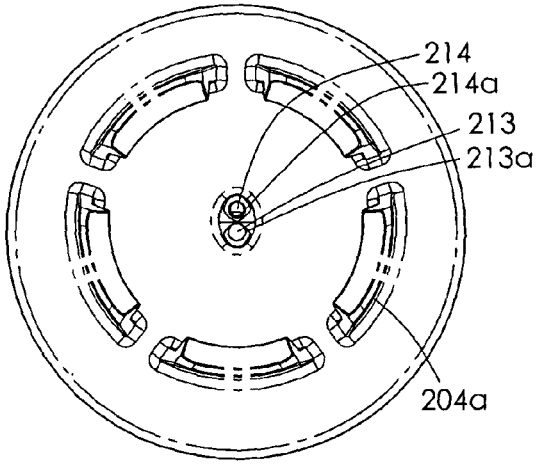

Referring now to FIGS. 20-22, lower housing 222 includes skirt 204 and segments 204*a* with undercuts 210. Flange 236 with fluid lumen 213 distally extends from housing 222 to provide spike 207. Fluid lumen opening 213*a* is positioned proximal to distal end 207*a* of spike 207. Vent lumen 214 having proximal end 214*b* positioned at base of flange 236 and below the top of lower housing support ribs 234 and distal opening 214*a* positioned proximal distal end 207*a* of spike 207. Upon assembly, vent lumen proximal end 214*b* is positioned below filter 209 and lower housing support ribs while flange 236 is operatively coupled to generic needle free valve assembly 223. Lumens 213 and 214 are shown in a parallel-axis relationship. Distal end 207*a* of spike 207 may be central to skirt 204.

Figure 23:
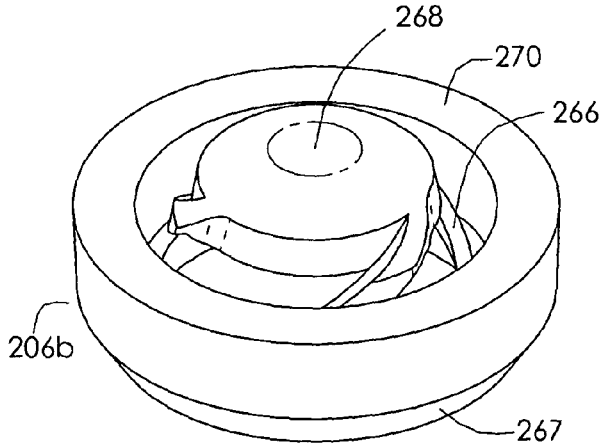
FIG. 23 is a perspective view of the check valve of the embodiments as shown in FIGS. 9 and 26.

Referring now to FIG. 23, an enlarged perspective view of check valve 206*a* is depicted. Resilient members 266 are integral with the respective disk portion 268 and with the respective ring portion 270 and extend in a spiral path between the respective disk portion 268 and the ring portion 270. Disk portion 268 of the check valve 206*b* may be sleeved on flange seat 218*b* with ring portion 270 secured by annular lip 218*b*. Optional beveled section 267 of check valve 206*b* provides for ease of assembly. As shown in FIG. 23, the one-way check valve is represented as a "spiral" type. Other types of check valves include, but are not limited to, "top hat," "double duck bill," "umbrella," "flat disc," and the like.

Figure 24:
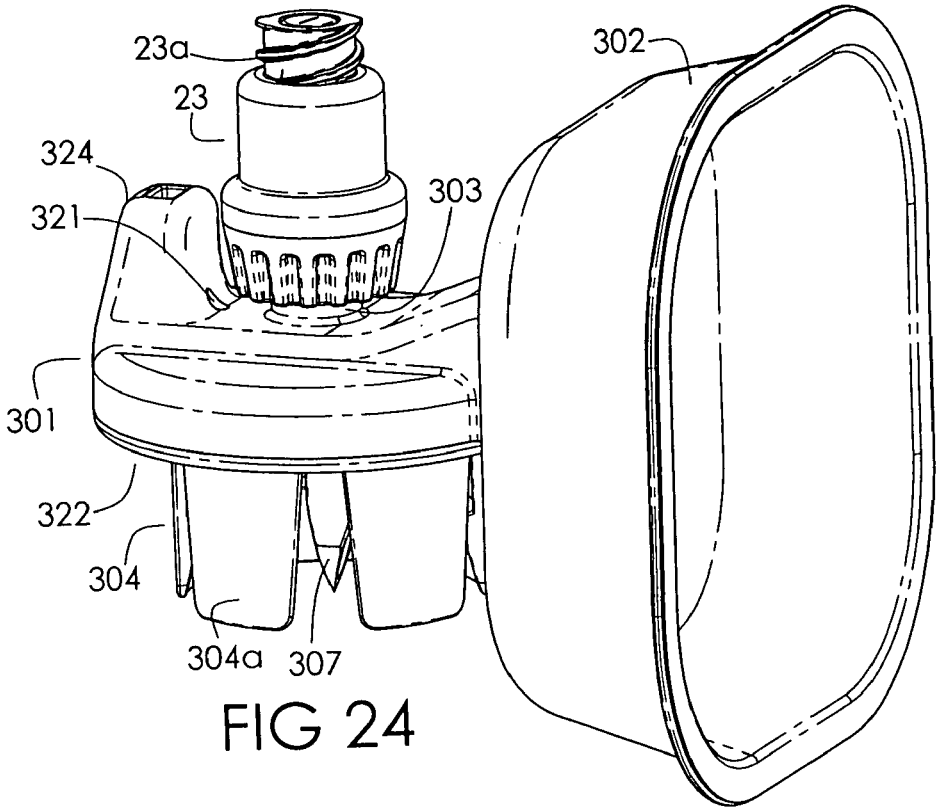
FIG. 24 is a perspective view of embodiment of the vial adapter.
Figure 25:
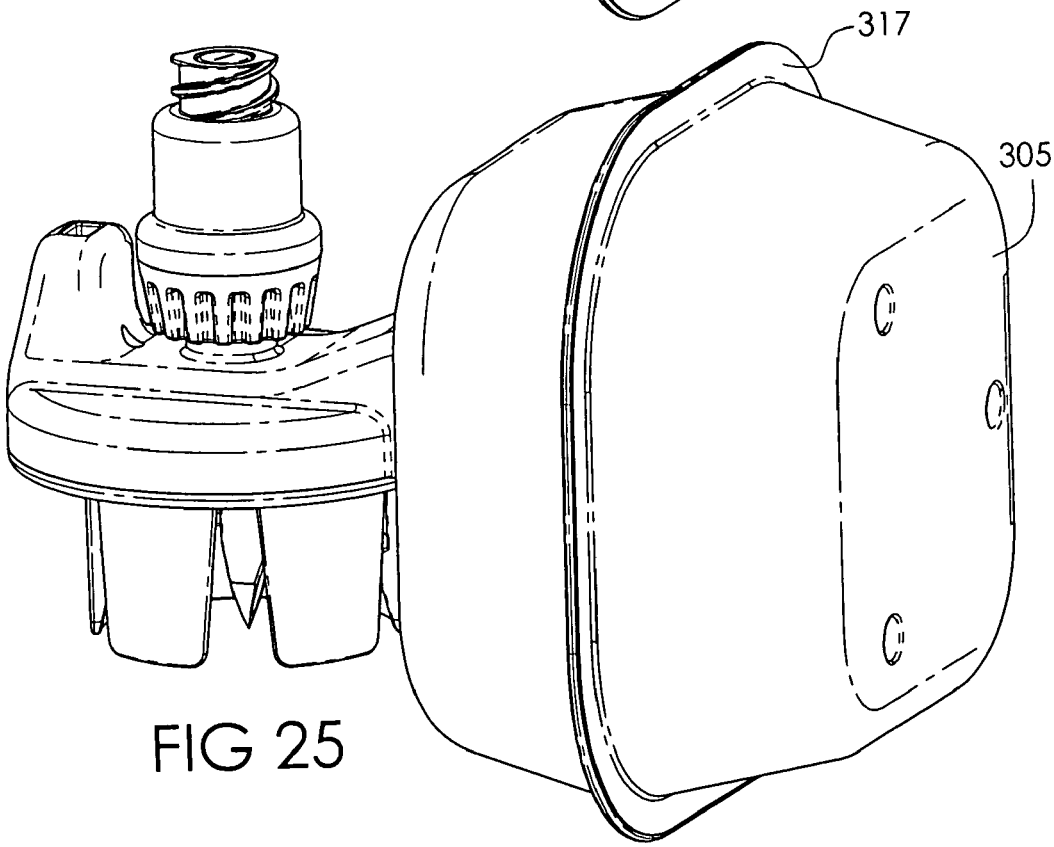
FIG. 25 is a perspective view of the embodiment as shown in FIG. 24 with the expandable chamber in an expanded state.

Referring now to FIGS. 24-38, another vial adapter embodiment is depicted. Generic needle-free valve assembly 23 having threaded elements 23*a* is securedly attached to upper housing 301 in fluid communication with hollow spike 307 and fluid lumen thereof. Housing lower portion 322 includes attachment assembly comprising skirt 304 having segments 304*a*. Finger gripping member 324 is positioned near vent opening 321 and opposite expandable chamber 302 and may provide means for comfortably grasping vial adapter. Finger gripping member 324 alone or in combination with positioning of check valve 206*a* may also provide counterweight to expandable chamber 305 of upper housing 301 such that when attached to drug container, the drug container may stand upright without tipping over. Unexpanded and expanded flexible membrane 305, sealed at face seal 317 of expandable chamber 302, is shown in an initial and final position in FIG. 24 and FIG. 25, respectively.

Figure 26:
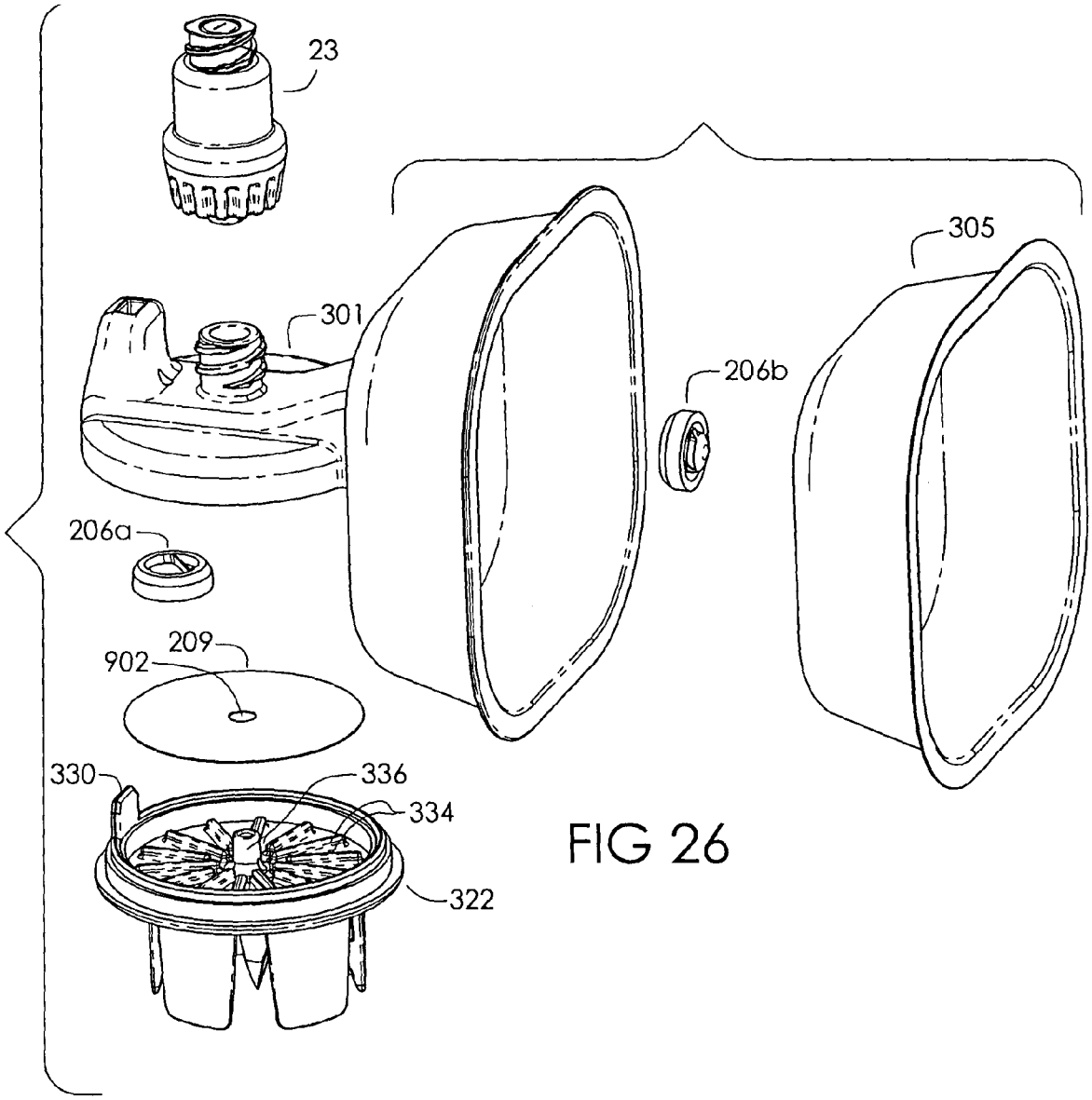
FIG. 26 is an exploded perspective view of the embodiment as shown in FIG. 24.

Referring now to FIG. 26, filter 209 includes opening 902 for sleeving on flange 336 of lower housing 322. Filter 209 is sealed to upper housing 301 at sealing surfaces 312*a* and 312*b*, and supported by upper and lower support ribs 333 and 334 respectively. Energy directors may be utilized with sealing ribs 312*a* and 312*b* for ultrasonic welding. Other surface effects or adhesives may be used to facilitate the sealing of filter 209 to upper housing 301. Lower housing 322 includes orientation tab 330 for proper alignment of housing members 301, 322 for assembly.

Figures 27, 28:
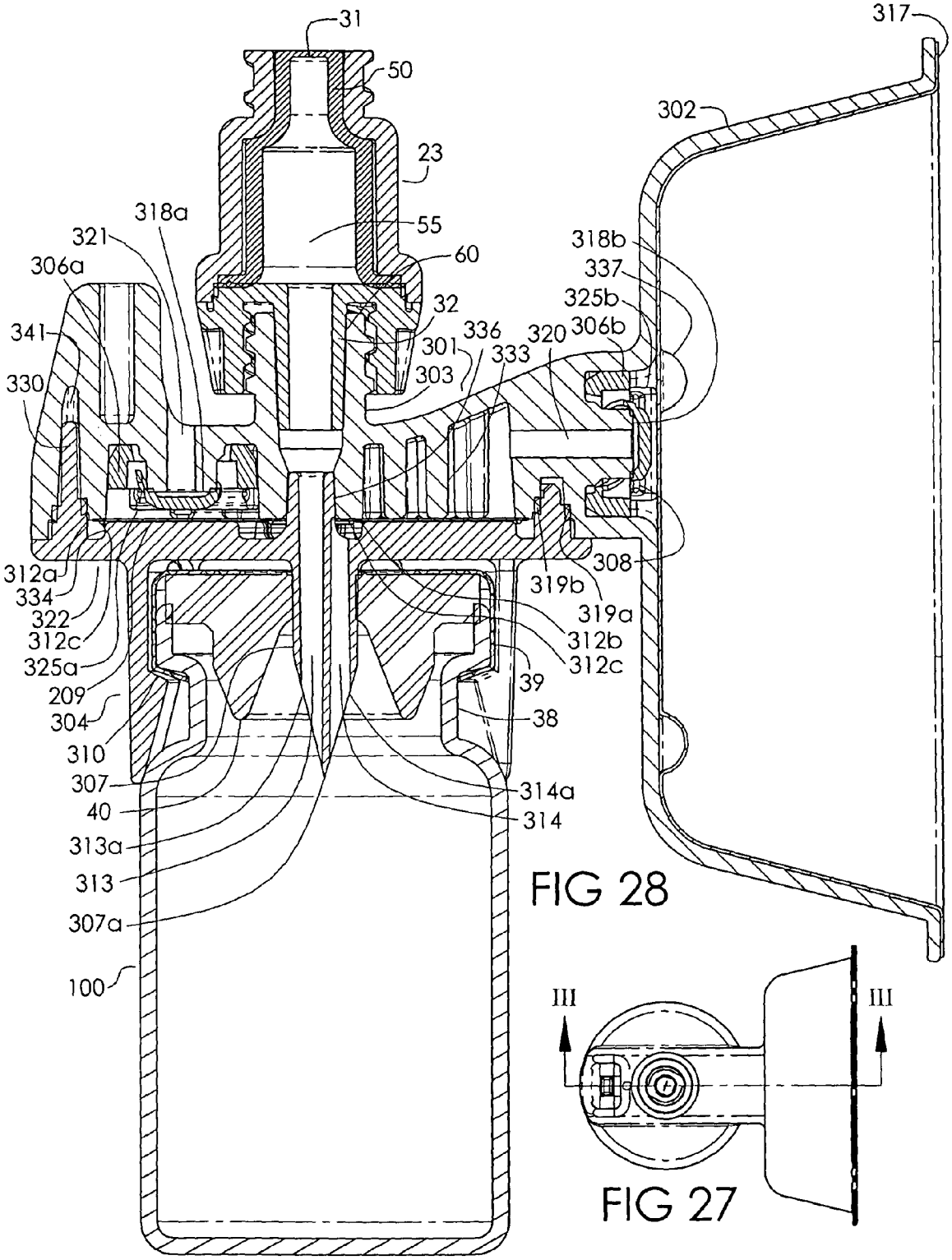
FIG. 27 is a top view of the embodiment as shown in FIG. 24.
FIG. 28 is a side cross-section view of the embodiment as shown FIG. 27, attached to a drug container.

Referring now to FIGS. 27 and 28, spike 307 penetrates septum 40 of cap 39 to provide access to drug container 100. Opening 313*a* of fluid lumen 313 proximal to spike distal end 307*a* is positioned forward of opening 314*a* of vent lumen 314. Opening 313*a* may be positioned rearward of 314*a* or may be positioned equally with 314*a*. Positional arrangement of openings 313*a* and 314*a* may be arranged as needed to prevent or eliminate crosstalk between the vent and fluid lumens during use. Check valve 306*a* is sleeved on flange seat 318*a* and secured by retaining fingers 325*a* providing one-way communication with passage 321. Check valve 306*b* is sleeved on flange seat 318*b* and secured by annular retaining fingers 325*b* providing one-way communication with passage 320. Passage 320 in combination with check valve 306*b* provides for one-way communication with vent lumen 314*a* and is cooperative with the combination of check valve 306*a* and passage 321 to direct fluid within the vial adapter. Recess 341 receives alignment tab 330 for assembly of upper and lower housings 301 and 322, respectively. Energy director elements 312*c* may be provided on or at sealing surfaces 312*a* and 312*b* which provide securing means for filter 209 upon assembly. Upper housing 301 is assembled to lower housing 322 by ultrasonically welding shear elements 319*a*' and 319*b*' of the upper housing 301 to shear elements 335*a*' and 335*b*' of the lower housing 322 to form shear joints 319*a* and 319*b* respectively. Both outer shear joint 319*a* and inner shear joint 319*b* serve to join the upper housing 301 to the lower housing 322, as well as isolate test ports 326 from the interior of the housing upon assembly. Other ultrasonic weld joints may be incorporated, such as energy director welds, or other joining processes such as spin welding, adhesives, and the like. Elements 337 facilitate the stacking of the barrier membrane so as to more easily separated them from each other and/or prevent them from sticking together prior to assembly with expandable chamber 302.

Figure 29:
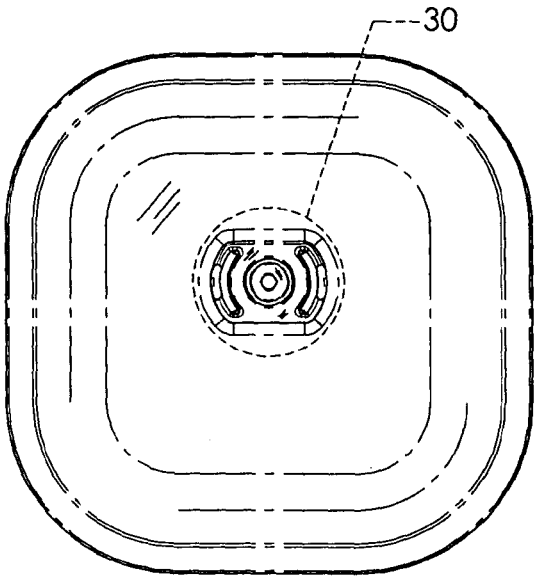
FIGS. 29-33 are various views of the upper housing of the embodiment as shown in FIG. 24.
Figure 30:
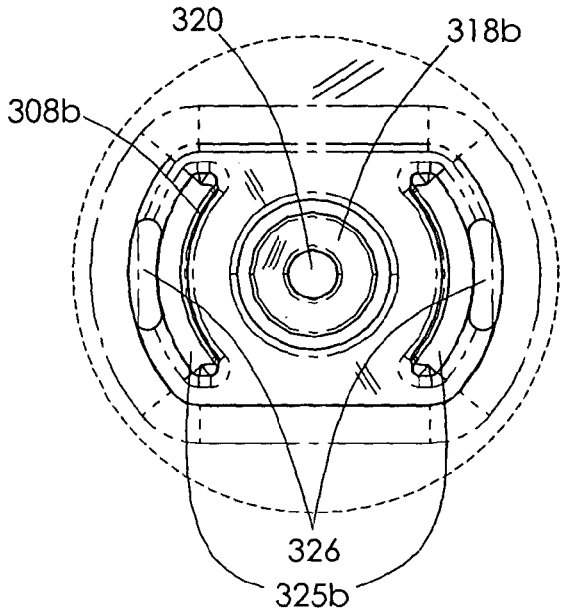
Figure 31:
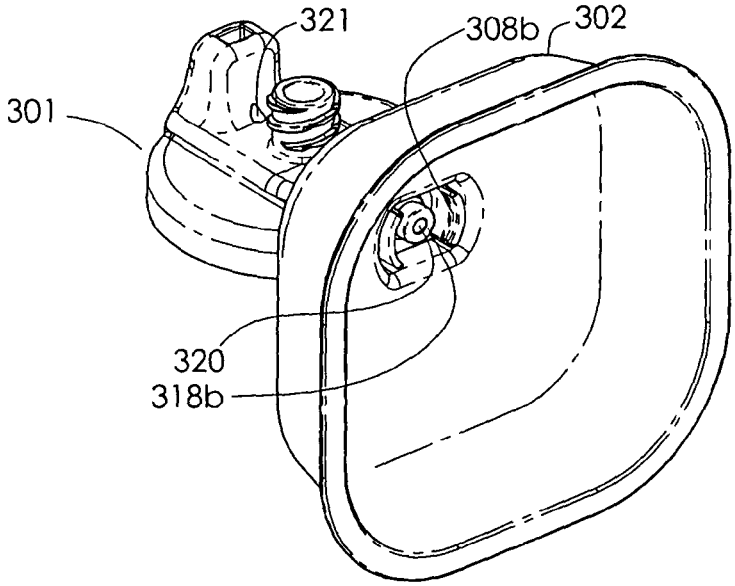

Referring now to FIGS. 29-31 expandable chamber 302 of upper housing 301 includes check valve flange seat 318*b* with passage 320 through upper housing 301. Optional test ports 326 provide access to bottom face of upper housing 301 and are isolated from internal passage 315. Test ports 326 may be used to leak test housing and check valve 306*b* and may be disabled prior to or during assembly of upper and lower housing members. Test ports 326 also may aid in the assembly of the barrier membrane as they may prevent air from getting trapped under the membrane if it is sealed to the upper housing before the housing components are joined.

Figure 33:
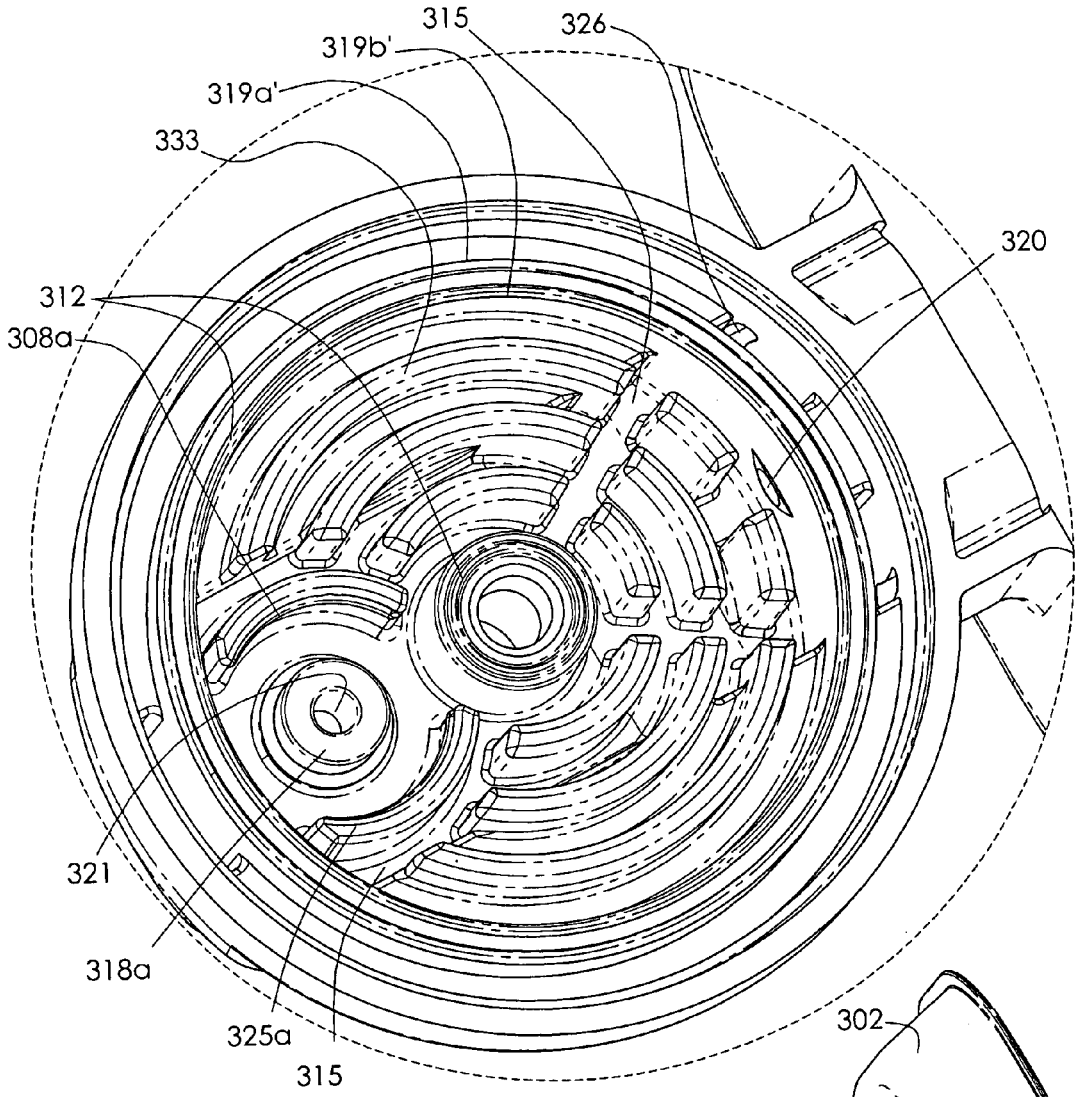
Figure 32:
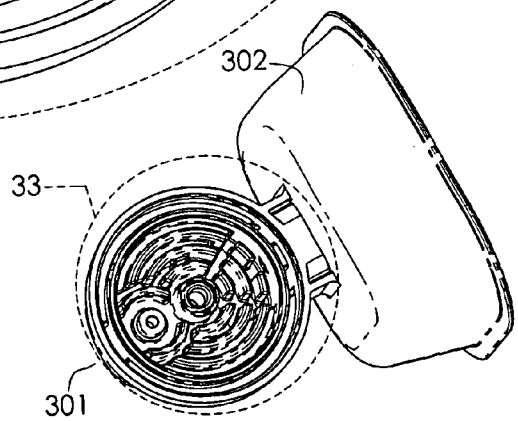
Figure 34:
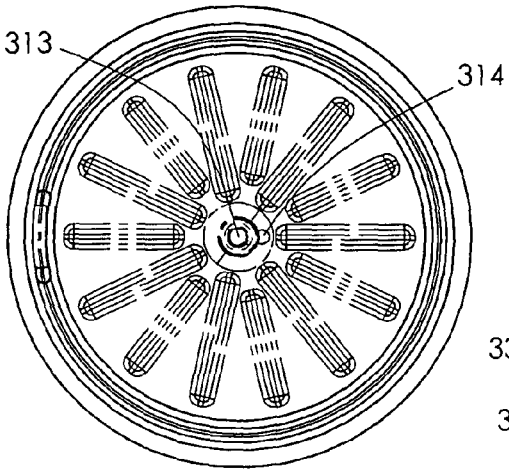
FIG. 34-38 are various views of the lower housing of the embodiment as shown in FIG. 24.
Figure 37:
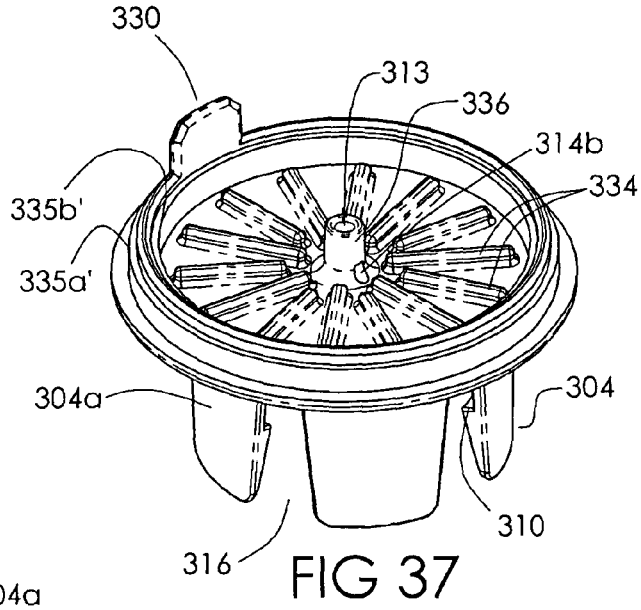
Figure 35:
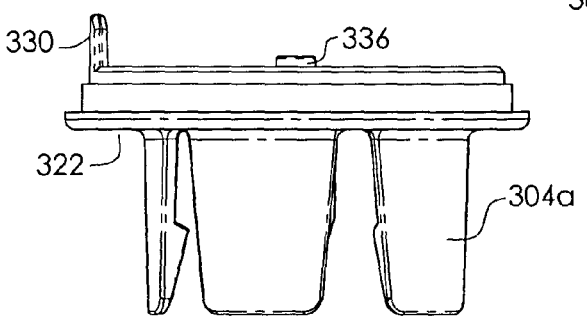
Figure 38:
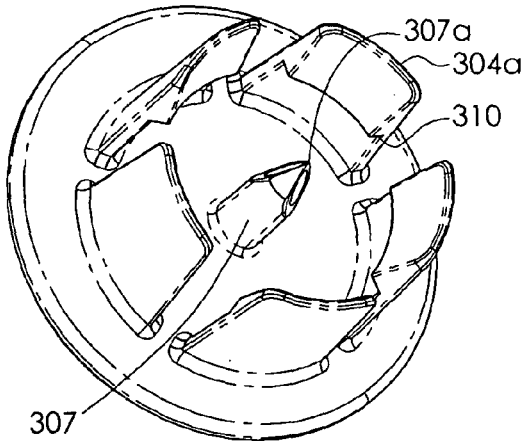
Figure 36:
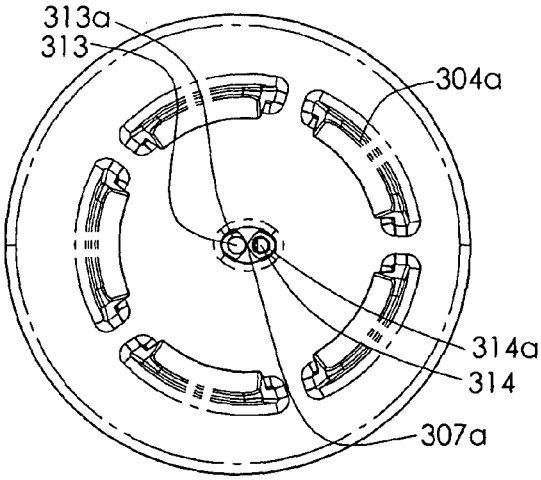

Referring now to FIGS. 32-33 upper support ribs 333 provide internal passage 315. Internal passage 315 provides for communication between passages 320 and vent lumen 314 as well as communication between passage 321 and vent lumen 314. Retaining fingers 325*a* with lip 308*a* provide sealing and/or retaining arrangement for check valve 306*a* which sits on flange seat 318*a*.

Referring now to FIGS. 34-38, lower housing 322 includes skirt 304 and segments 304*a* with undercuts 310. Flange 336 with fluid lumen 313 distally extends from housing 322 to provide spike 307. Fluid lumen opening 313*a* positioned proximal to distal end 307*a* of spike 307. Vent lumen 314 having proximal end 314*b* positioned at base of flange 336 and below the top of lower housing support ribs 334 and distal opening 314*a* positioned proximal to distal end 307*a* of spike 307. Upon assembly, vent lumen proximal end 314*b* is positioned below filter 209 and lower housing support ribs while flange 336 is operatively coupled to generic needle free valve assembly 23. Lumens 313 and 314 are shown in parallel axis relationship Distal end 307*a* of spike 307 may be central to skirt 304.

Figure 39:
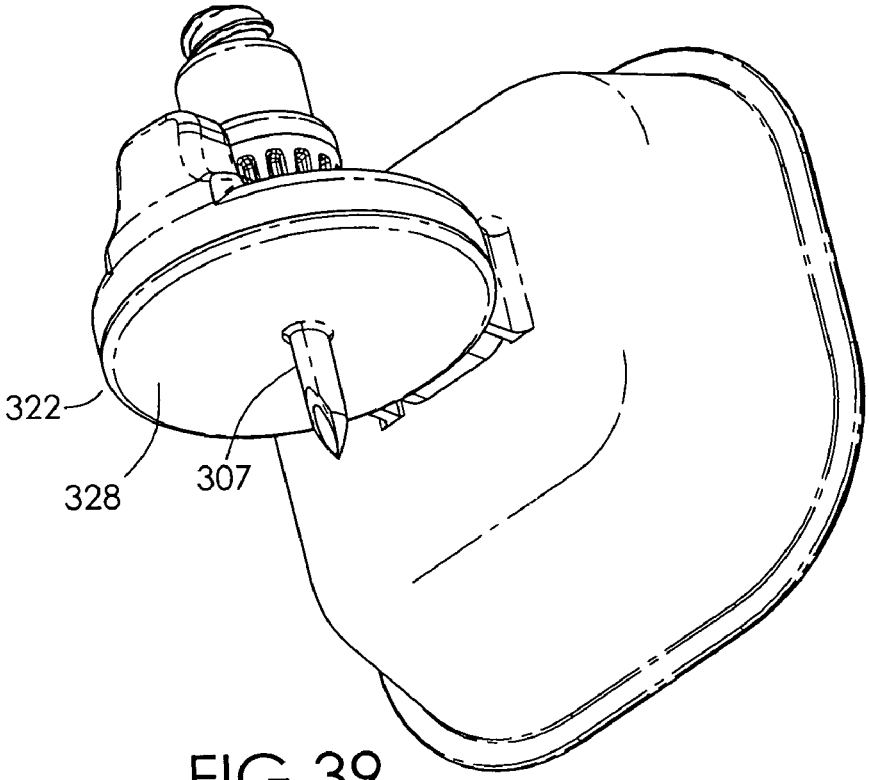
FIGS. 39-40 are a perspective views of embodiments as shown in FIG. 24 with different lower housings.
Figure 40:
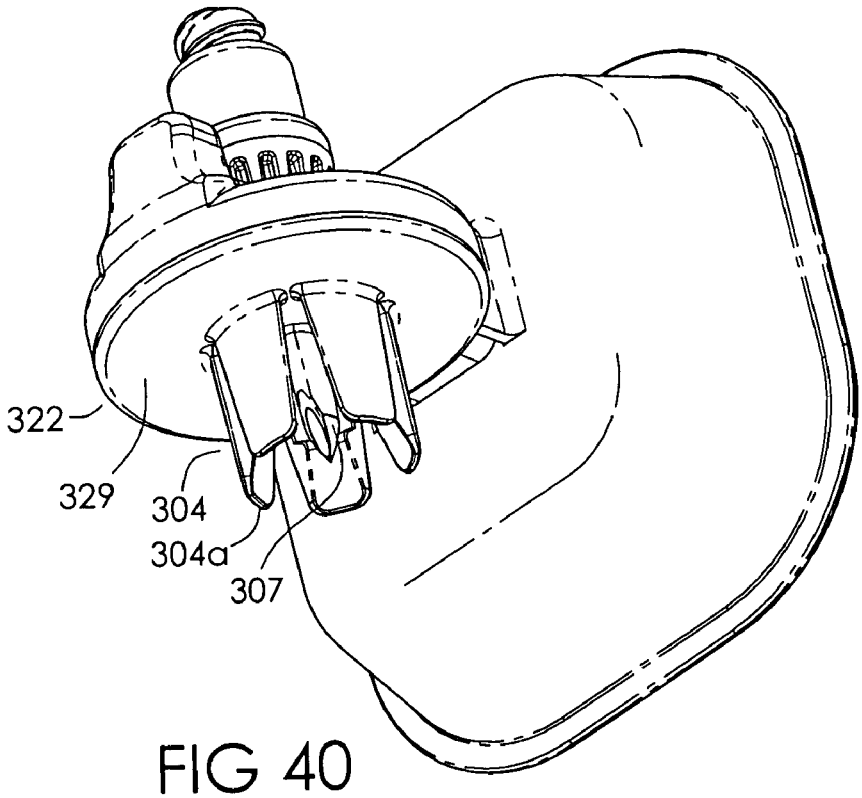

Referring now to FIGS. 39 and 40, vial adapter housing 322 without vertical segments and with annular skirt is depicted, respectively. Spike 307 projects from face 328 of housing 322. Alternatively, spike 307 projects from face 329 and is surrounded by segments 304*a* of skirt 304.

In use, it is contemplated that the vial adapter would be provided to the user in a separate sterile package. The user would open the package with the vial adapter in the condition as shown, by example, in FIG. 24. In this condition, the user simply grasps the housing and/or finger gripping member and moves the slotted skirt vertically downward over the stopper assembly of the drug container until the face of housing lower portion meets the top surface of drug container closure and undercuts engage beneath the stopper assembly.

In this configuration, the drug container may be constituted by introduction of fluid, such as a diluent, through the needle-free valve assembly. If necessary, the drug container is agitated to complete the mixing procedure required to constitute the solution. With the apparatus thus constituted, there are several modes of use depending upon whether the dosage of hazardous material within drug container is a one-dosage amount or a multiple dosage amount. Assuming it to be a single dosage amount and assuming the situation where the user who is to constitute the solution is also the person to use the solution after it is constituted, a typical use is set forth below.

As shown in FIG. 28, the drug container 100 may contain a dosage of medicament in need of reconstitution, for example, in the lower portion thereof. Upon reconstitution, gaseous fluid and/or aerosol, which may include saturated vapor of the hazardous material solution, may be generated. The gaseous fluid and/or vapor are urged into the internal passage 315 through check valve 306*b* and into the expandable chamber 302 by virtue of the added volume of the diluent. Thereafter, the user may simply invert the entire apparatus with the syringe or connector maintained in fluid communication with the vial adapter and drug container and then withdraws the plunger. The gaseous fluid and/or vapor remains within the expandable chamber 302. Vent lumen 314 in communication with the internal passage and check valve 306*a* provides ambient pressure to the drug container.

In situations where the reconstituting procedures are separated from the filling and withdrawing procedures, a typical mode of use in accordance with the principles of the aforementioned embodiments is set forth below, assuming a one dosage drug container in use with the vial adapter. The reconstituting procedure involves engaging a diluent syringe or connector with threaded element of the needle-free adapter assembly, for example 323. Thereafter, the diluent is provided through the needle-free adapter 323 into the fluid lumen and into the drug container. When this movement of diluent has been completed the drug container may be retained in its upright position so that the liquid is in the lower portion of the drug container and the open end of the fluid lumen 313 of the spike is in communication with the fluid within the drug container. Positive pressure generated by the introduction of a volume to the assemblage may be relieved by one-way communication through the open end of the vent lumen into the internal passage and through cooperative check valve 206*b* and contained within expandable chamber 302. The operator may then withdraw material from the drug container. Opening 321 in housing in one-way communication with check valve 206*a* maintains ambient pressure within the drug container. The operator may then remove the connector from the access member.

This fluid headspace in the drug container may be air with perhaps some hazardous material entrained therein. The air is urged to pass through the filter 209 and outwardly through the internal passage. Filter 209 prevents or restricts the passage of hazardous liquid material into the internal passage. Support ribs 333 and 334 in upper and lower housing 301 and 322, respectively, provide structural support and/or securing means for the filter and prevent or eliminate bow or deflection of the filter while deflecting liquid and allowing gas passage. Arrangement of the support ribs 333 and 334 may be in any geometric pattern. The internal support structure provided by the ribs allows for free passage of air while supporting the filter. After the gaseous fluid has been secured in the expandable chamber 302 the connector may be kept engaged with the needle-free adapter 323. In this way, the drug container 100 with the vial adapter and connector still engaged may be transported to the place of use, any gases and liquid medicament being contained within the drug container at substantially atmospheric pressure conditions.

When it is desired to withdraw liquid medicament from a drug container, a connector may be engaged with the access member or attached needless adapter. If the connector is a syringe, the syringe may be engaged to the access member with the syringe plunger disposed from its fully engaged position to an extent such that the volume within the syringe defined by the plunger is generally of a volume equal to or more than the desired dosage to be withdrawn. Thus, this volume of the dosage syringe is initially filled with air. The syringe plunger may then be depressed so as to inject the air into the access member and through the fluid lumen of the spike into the drug container thus providing a volume therein. The volume is displaced into the internal passage via the vent lumen and urged through the check valve and is contained in the expandable chamber.

Advantageously, a syringe may be engaged to the needle-free adapter with the plunger disposed in its fully engaged position without a charge of air for directly withdrawing a volume of liquid from the drug container. The vial adapter including the drug container may then be inverted and the operator may withdraw liquid medicament from within the drug container to pass into the fluid lumen and into the syringe by moving the syringe plunger rearwardly from its fully engaged position. Air for replacing the withdrawn volume is drawn into the vial adapter via the one-way communication with opening and into the drug container via internal passage and vent lumen to maintain the ambient pressure in the drug container. Filtering of the air may be provided as discussed above.

This vial adapter herein described addresses various shortcomings of existing vial adapters and provides additional safety advantages. A pair of cooperative check valves of the vial adapter may avoid or eliminate internal pressure build-up and urge air and vapor into the expandable chamber of the vial adapter. Thus, release of harmful drugs into the atmosphere and unnecessary exposure to the clinician is eliminated or avoided. The cooperative check valves in combination with the expandable chamber may contain the vapors within the device should the vial adapter be removed from the drug container or the needle-free valve or syringe be removed from the access member of the vial adapter.

The vial adapter described above will normally be supplied in assembled form or as a kit, and may be sterile. The term "vial adapter" as used herein is intended to include within its scope the elements thereof in partially or fully disassembled form as well. The vial adapter or kit may contain an access member and a particular needle-free adapter which may be separate, secured to or permanently affixed to the access member as desired.

As used herein, "comprising," "including," "containing," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

While the invention has been described in detail and with reference to specific embodiments thereof, it will be apparent to one skilled in the art that various changes and modifications may be made without departing from the spirit and scope of the invention.

What is claimed is:

1. A vial adapter comprising:

a housing, the housing comprising an expandable chamber to contain a volume, wherein the expandable chamber transitions from an initial volume to a final volume greater than the initial volume upon containing the volume;

an internal passage in communication with the expandable chamber;

at least one opening in communication with the internal passage;

an access member integral with the housing;

a spike comprising a proximal end integral with the housing and a distal end, the spike further comprising a vent lumen open at the distal end and a fluid lumen open at the distal end, the vent lumen in communication with the internal passage and the fluid lumen in communication with the access member;

a first check valve restricting communication from the internal passage to the at least one opening; and a second check valve restricting communication from the expandable chamber to the internal passage.

2. The vial adapter according to claim 1, further comprising a skirt portion integral with the housing and at least partially surrounding the spike, the skirt portion having at least one securing member for securing the vial adapter to a sealed vessel such that the spike accesses the interior of the vessel.

3. The vial adapter according to claim 1, further comprising at least one hydrophobic filter.

4. The vial adapter according to claim 3, wherein the at least one hydrophobic filter is in communication with both the vent lumen and the opening.

5. The vial adapter according to claim 3, wherein the at least one hydrophobic filter is in communication with both the vent lumen and the expandable chamber.

6. The vial adapter according to claim 3, wherein the at least one hydrophobic filter is between the vent lumen and the opening.

7. The vial adapter according to claim 3, wherein the at least one hydrophobic filter is between the vent lumen and the expandable chamber.

8. The vial adapter according to claim 1, wherein the expandable chamber is expandable such as to contain at least a portion of a fluid volume equivalent to that introduced through the access member.

9. The vial adapter according to claim 8, wherein the expandable chamber is at ambient pressure in the expanded position.

10. The vial adapter according to claim 8, wherein the expandable chamber is at greater than ambient pressure in an expanded position.

11. The vial adapter according to claim 1, wherein at the first check valve is positioned between the opening and the internal passage.

12. The vial adapter according to claim 1, wherein at the second check valve is positioned between the expandable chamber and the internal passage.

13. The vial adapter according to claim 1, wherein the first and/or second check valve restricts leakage at less than 2 psi.

14. The vial adapter according to claim 1, wherein the access member is a needle-free valve.

15. The vial adapter according to claim 14, wherein the needle-free valve comprises a female opening securable to a male connector such that two-way fluid communication is provided through the access member.

16. The vial adapter according to claim 14, wherein the needle-free valve is self-sealing.

17. The vial adapter according to claim 1, further comprising a needle-free valve connector secured with the access member of the housing.

18. The vial adapter according to claim 1, wherein the spike is plastic.

19. A vial adapter for entering the interior of a drug container fitted with a penetrable closure and for removing material from or adding material to the drug container, the vial adapter comprising: a housing, the housing comprising:

a hollow spike proximally extending from the housing and open proximal to the distal end, the spike comprising a fluid lumen having an open end and a vent lumen having an open end;

an internal passage providing two-way communication with the interior of the drug container via the vent lumen, an access member providing two-way communication with the interior of the drug container via the fluid lumen, and an opening in one-way fluid communication with the internal passage for maintaining the internal drug container at ambient pressure when removing material from the drug container via the access member and for restricting fluid transfer from the internal passage; and an expandable chamber integral with the housing, the expandable chamber in one-way fluid communication with the internal passage, wherein the expandable chamber transitions from an initial volume to a final volume greater than the initial volume upon containing the volume.

20. The vial adapter according to claim 19, wherein the access member is a needle-free valve.

21. The vial adapter according to claim 20, wherein the needle-free valve comprises a female opening securable to a male connector such that two-way fluid communication is provided through the access member.

22. The vial adapter according to claim 20, wherein the needle-free valve is self-sealing.

23. The vial adapter according to claim 19, further comprising a needle-free valve connector secured with the access member of the housing.

24. The vial adapter according to claim 19, further comprising a skirt portion integral with the housing and at least partially surrounding the spike, the skirt portion having securing members for securing the vial adapter to the drug container such that the spike accesses the interior of the vessel.

25. The vial adapter according to claim 19, wherein the internal passage includes a first check valve positioned between the opening and the internal passage.

26. The vial adapter according to claim 19, wherein the internal passage includes a second check valve positioned between the expandable chamber and the internal passage.

27. The vial adapter according to claim 19, wherein the first and/or second check valve restricts leakage at less than 2 psi.

28. The vial adapter according to claim 19, wherein the check valve is a spiral check valve, ball check valve, duck-bill check valve or swing check valve.

29. The vial adapter according to claim 19, further comprising at least one hydrophobic filter.

30. The vial adapter according to claim 29, wherein the at least one hydrophobic filter is in communication with both the vent lumen and the opening.

31. The vial adapter according to claim 29, wherein the at least one hydrophobic filter is in communication with both the vent lumen and the expandable chamber.

32. The vial adapter according to claim 29, wherein the at least one hydrophobic filter is between the vent lumen and the opening.

33. The vial adapter according to claim 29, wherein the at least one hydrophobic filter is between the vent lumen and the expandable chamber.

34. The vial adapter according to claim 19, wherein the spike is plastic.

35. A vial adapter for a drug container comprising:

a housing having an upper section and a lower section in sealed relationship, each upper and lower section having a top and bottom surface;

a hollow spike having a proximal end extending from the top surface of the lower housing section forming a flange, the spike further having a distal end extending from the bottom surface of the lower housing, the spike having a fluid lumen parallel with a vent lumen, the fluid lumen and the vent lumen being open at the proximal end of the spike and the fluid lumen and the vent lumen being open proximal to the distal end of the spike;

an access member integral with the upper housing section, the access member having a two-way communicable passage through the fluid lumen of the spike;

an opening through the upper housing; a filter positioned between the upper and the lower housing sections;

an internal passage positioned between the upper and the lower housing sections, the internal passage in fluid communication with the opening and the vent lumen, the internal passage being isolated from the fluid lumen;

a first check valve providing one-way fluid communication through the opening into the internal passage;

an expandable chamber integral with the housing and in fluid communication with the internal passage of the housing, the expandable chamber having a flexible member secured thereto, wherein the expandable chamber transitions from an initial volume to a final volume greater than the initial volume upon containing the volume; and a second check valve providing one-way communication through the internal passage and into the expandable chamber.

36. The vial adapter according to claim 35, further comprising a skirt member integral with and extending from the bottom face of the lower housing section, the skirt at least partially surrounding the spike.

37. The vial adapter according to claim 36, wherein the skirt portion comprises segmented sections separated by gaps.

38. The vial adapter according to claim 37, wherein the segmented sections comprise inwardly projecting undercuts.

39. The vial adapter according to claim 35, wherein the access member is a needle-free valve.

40. The vial adapter according to claim 39, wherein the needle-free valve comprises a female opening securable to a male connector such that two-way fluid communication is provided through the access member.

41. The vial adapter according to claim 39, wherein the needle-free valve is self-sealing.

42. The vial adapter according to claim 35, further comprising a needle-free valve secured with the access member of the housing.

43. The vial adapter according to claim 35, further comprising first supporting rib members extending from the bottom surface of the upper housing section.

44. The vial adapter according to claim 35, further comprising second supporting rib members extending from the top surface of the lower housing section.

45. The vial adapter according to claim 35, further comprising first supporting rib members extending from the bottom surface of the upper housing section and second supporting rib members extending from the top surface of the lower housing section.

46. The vial adapter according to claim 43, wherein the first supporting rib members are in sealed relationship with the filter.

47. The vial adapter according to claim 45, wherein the filter is supported between the first and second supporting rib members.

48. The vial adapter according to claim 35, further comprising a finger gripping member projecting from the top surface of the upper housing section.

49. The vial adapter according to claim 35, wherein the expandable chamber is bell-shaped.

50. The vial adapter according to claim 43, wherein the flexible member is peripherally sealed around the bell-shaped expandable chamber.

51. The vial adapter according to claim 35, wherein the filter is a hydrophobic filter.

52. The vial adapter according to claim 35, wherein the expandable chamber is expandable such as to contain at least a portion of a fluid volume equivalent to that introduced through the access member.

53. The vial adapter according to claim 35, wherein the expandable chamber is at ambient pressure in the expanded position.

54. The vial adapter according to claim 35, wherein the expandable chamber is at greater than ambient pressure in an expanded position.

55. The vial adapter according to claim 35, wherein the first and second check valves are spiral check valves, ball check valves, duck-bill check valves, swing check valves or combinations thereof.

56. The vial adapter according to claim 55, wherein at the first check valve and second check valve are spiral check valves.

57. The vial adapter according to claim 35, wherein at the first check valve is positioned between the opening and the internal passage.

58. The vial adapter according to claim 35, wherein at the second check valve is positioned between the expandable chamber and the internal passage.

59. The vial adapter according to claim 35, wherein at the first check valve and second check valve are orthogonal to each other.

60. The vial adapter according to claim 35, wherein the first and/or second check valve restricts leakage at less than 2 psi.

61. The vial adapter according to claim 35, wherein the spike is plastic.

62. A method of reconstituting and/or withdrawing hazardous material comprising:

providing a drug container comprising hazardous material;

securing a vial adapter as defined in claim 1 to the drug container; and reconstituting and/or withdrawing hazardous material of the drug container via the access member of the vial adapter such that positively displaced volume is one-way communicated to the expandable chamber and/or venting of the drug container is one-way communicated through the opening to the drug container.

* * * * *

UNITED STATES PATENT AND TRADEMARK OFFICE

CERTIFICATE OF CORRECTION

PATENT NO. : 7,743,799 B2
APPLICATION NO. : 11/593328
DATED : June 29, 2010
INVENTOR(S) : Theodore J. Mosler et al.

It is certified that error appears in the above-identified patent and that said Letters Patent is hereby corrected as shown below:

Face of Patent

Field (73): "Industrie Borta S.p.A., Moncalieri, Turin (IT)" should be --Industrie Borla S.p.A., Moncalieri, Torino (IT)--

Signed and Sealed this

Seventeenth Day of August, 2010

David J. Kappos

David J. Kappos
*Director of the United States Patent and Trademark Office*